US005399472A

United States Patent [19]

Hall et al.

[11] Patent Number: 5,399,472

[45] Date of Patent: Mar. 21, 1995

[54] COUPLER BLENDS IN COLOR PHOTOGRAPHIC MATERIALS

[75] Inventors: Jeffrey L. Hall; Richard Szajewski, both of Rochester, N.Y.

[73] Assignee: Eastman Kodak Company, Rochester, N.Y.

[21] Appl. No.: 869,988

[22] Filed: Apr. 16, 1992

[51] Int. Cl.[6] ..... G03C 7/46; G03C 1/08; G03C 7/26; G03C 7/32

[52] U.S. Cl. ..... 430/549; 430/382; 430/386; 430/544; 430/554; 430/555; 430/558

[58] Field of Search ..... 430/549, 382, 544, 554, 430/386, 555, 558

[56] References Cited

U.S. PATENT DOCUMENTS

| | | | |
|---|---|---|---|
| 4,443,536 | 4/1984 | Lestina | 430/552 |
| 4,600,688 | 7/1986 | Kawakatsu et al. | 430/558 |
| 4,675,280 | 6/1987 | Kaneko et al. | 430/549 |
| 4,755,455 | 7/1988 | Iwasa | 430/558 |
| 4,808,502 | 2/1989 | Merkel | 430/17 |
| 4,830,955 | 5/1989 | Kajiwara et al. | 430/382 |
| 4,842,994 | 6/1989 | Sakanoue et al. | 430/543 |
| 4,865,959 | 9/1989 | Sakanoue et al. | 430/548 |
| 4,885,234 | 12/1989 | Zengerle | 430/546 |
| 4,954,431 | 9/1990 | Nishijima et al. | 430/554 |
| 4,990,431 | 2/1991 | Bagchi et al. | 430/372 |
| 5,001,045 | 3/1991 | Furutachi et al. | 430/545 |
| 5,084,375 | 1/1992 | Umemoto et al. | 430/505 |
| 5,091,296 | 2/1992 | Bagchi et al. | 430/546 |
| 5,110,718 | 5/1992 | Tanji et al. | 430/554 |

FOREIGN PATENT DOCUMENTS

| | | |
|---|---|---|
| 0254151 | 7/1987 | European Pat. Off. . |
| 0284240 | 9/1988 | European Pat. Off. . |
| 0285274 | 10/1988 | European Pat. Off. . |
| 0359169 | 3/1990 | European Pat. Off. . |
| 0422595 | 4/1991 | European Pat. Off. . |
| 0434028 | 6/1991 | European Pat. Off. . |
| 2160971 | 8/1972 | Germany . |
| 61-80251 | 4/1986 | Japan . |
| 62-141553 | 6/1987 | Japan . |
| 91/016012B | 4/1991 | Japan . |
| 03/242644A | 10/1991 | Japan . |

*Primary Examiner*—Charles L. Bowers, Jr.
*Assistant Examiner*—J. Pasterczyk
*Attorney, Agent, or Firm*—Arthur E. Kluegel

[57] ABSTRACT

A silver halide emulsion is disclosed including a blend of a first image dye-forming coupler which does not intrinsically inhibit development of silver halide, and a second image dye-forming coupler which intrinsically inhibits development of silver halide. The intrinsically development inhibiting couplers are defined empirically versus a standard coupler. For purposes of this invention DIR couplers are not considered intrinsically development inhibiting couplers. Photographic elements and methods for developing images using the coupler blends are also disclosed.

50 Claims, No Drawings

COUPLER BLENDS IN COLOR PHOTOGRAPHIC MATERIALS

BACKGROUND OF THE INVENTION

This invention pertains to photographic elements and silver halide emulsions comprising a mixture of at least two different dye-forming image couplers, and to methods of developing images using the elements.

Images are commonly obtained in the photographic art by a coupling reaction between the development product of a silver halide developing agent (e.g., an oxidized aromatic primary amino developing agent) and a color-forming compound known as a coupler. The dyes produced by the coupling reaction are indoaniline, azomethine, indamine or indophenol dyes, depending on the chemical composition of the coupler and the developing agent. Ordinarily the subtractive process of color formation is employed, and the resulting image dyes are usually cyan, magenta and yellow dyes which are formed in or adjacent to silver halide layers sensitive to red, green and blue radiation, respectively. Typically, phenol or naphthol couplers are used to form the cyan dye image, pyrazolone or pyrazolotriazole couplers are used to form the magenta dye image, and acylacetaniline couplers are used to form the yellow dye image.

Image coupler blends can be used as aggregates to attain properties intermediate between those of the individual component image couplers. Typically, blends provide levels of fog density (Dmin), gamma, image density formation (which may be quantified as Dmax) and dye hue which vary in a parallel fashion and which can be readily estimated by interpolation from the values associated with each individual coupler, as weighted by the relative quantity of each coupler and by the relative coupling reactivity of each coupler.

Blends of cyan dye-forming couplers have been employed in this fashion to enable improved physical properties such as decreased coupler crystallization during manufacture or storage while maintaining other desired photographic properties. Such a use is described, for example, in U.S. Pat. Nos. 4,842,994; 4,865,959; 4,885,234; and published European Patent Application 0 434 028. Related uses of blends of cyan dye forming image couplers are described in U.S. Pat. No. 5,084,375; published European Patent Application 0 254 151 B; Japanese Kokoku J91/016,102 B; and Japanese Kokai J03/242,644 A.

Blends of magenta dye-forming image couplers that can be used in a single layer of a color paper are known. For example, Japanese Kokai 61-80251 mentions that two magenta image forming couplers of the same hue can be used in the magenta record of a color paper. No criteria for selection of specific magenta image dye-forming couplers to be combined are set forth in this reference, however. Furthermore, neither the properties nor the potential advantages of such combinations are described.

Use of two magenta dye-forming image couplers, each of narrowly specified structure, to provide desirable dye hue while enabling improved formalin resistance is described at U.S. Pat. No. 4,600,688. The density forming properties appear to be just those expected from the aggregation of the individual components while the dye hues and formalin resistance are described as being unexpected based on the individual properties of the components. This patent discloses that the two magenta dye-forming image couplers may be employed as a blend in a single photographic layer or may be employed individually in two or more photographic layers sensitized to substantially the same region of the electromagnetic spectrum. Examples illustrating both usages are provided. The aggregates described appear to have no unexpected impact on image density formation or gamma.

Certain magenta dye-forming image couplers, such as coupler M-8 of U.S. Pat. No. 4,443,536, are highly useful because of the improved dye hue and dye stability, reduced unwanted absorption and improved formalin resistance that they exhibit after color development. For this reason such couplers are often preferred to couplers such as CC-11 of the '536 patent. Coupler M-8 of the '536 patent can, however, exhibit less than fully satisfactory dye density formation after an image exposure and development.

Efforts to improve the dye density formation performance while maintaining the desired dye hue and stability characteristics have led to magenta dye-forming image couplers such as compound V of EP 0 285 274 (corresponding to Romanet et al., U.S. Ser. No. 23,518) and the compound at page 12, line 5 of EP 0 284 240. While these compounds provide improved dye density formation and improved gamma over those of the '536 patent, they also exhibit a higher than desirable degree of fog growth.

One approach to enabling both improved image dye hue and stability and dye density formation involves providing combinations of magenta dye-forming image couplers with chalcogenazolium salts as described in EP 0 359 169 A. The higher than desirable fog growth may, however, persist in this case.

Another approach has been to use alternative coupler solvents which may alter the partitioning of the coupler or the image dye formed from the coupler in the gelatin matrix of the photographic element as described in U.S. Pat. No. 4,808,502. Such alternative solvents, however, can lead to activity changes in the coupler and hue changes in the dye formed from the coupler.

There has thus been a need for photographic elements which display low fog density together with good density in image-forming areas. Such photographic elements should exhibit superior image-to-fog discrimination.

SUMMARY OF THE INVENTION

These needs have been satisfied by providing a photographic element comprising a support, a silver halide emulsion, a first dye-forming image coupler which does not enable development inhibition of said silver halide (a class A coupler), and a second dye-forming image coupler which enables development inhibition of said silver halide (a class B coupler). In a preferred embodiment, one or both image-dye forming couplers are magenta dye-forming couplers. In a particularly preferred embodiment, the magenta dye-forming couplers are pyrazolotriazole couplers or pyrazolone couplers.

There are also provided multicolor photographic elements, processes for the formation of an image and silver halide emulsions employing the novel combination of image couplers.

DETAILED DESCRIPTION OF THE INVENTION

It has now been discovered that blends of couplers according to the invention achieve gamma, Dmax and granularity values which unexpectedly are dominated by the non-development inhibiting (class A) coupler, while the fog density (Dmin) of the blends corresponds to the expected weighted average value. Based on the properties of class B couplers, it might have been expected that the class B coupler would dominate Dmin, gamma, Dmax and granularity values, or in the alternative that these properties would correspond to the weighted average of the two couplers, that is, that the blend would act an an aggregate.

The coupler blends according to the invention thus provide excellent control of fog density (Dmin), while simultaneously allowing good density formation in the image areas of the film, thus enabling improved image-to-fog discrimination. An additional unexpected advantage of the inventive blends is an improvement in the image-dye granularity. Another unexpected advantage of the inventive blends in a color sensitive element resides in the surprisingly low level of interimage onto that color in a multilayer/multicolor color negative film.

Class A image couplers according to the invention do not enable development inhibition, while Class B couplers enable development inhibition. Image couplers are identified as showing non-inhibiting (class A) or intrinsically development inhibiting (class B) behavior based on the following photographic test:

The image couplers to be evaluated are typically dispersed with one-half their weight of tricresyl phosphate in gelatin following procedures well-known to those skilled in the photographic art. The dispersion containing the image coupler is then incorporated in a photographic element by applying the following layers in the given sequence:

| | |
|---|---|
| OC | Gelatin (2688 mg/m$^2$)<br>bis(vinylsulfonylmethyl) ether hardener (hardener H-1, 2% of total gelatin)<br>saponin at 1.5% melt volume |
| EMULSION LAYER | Gelatin (3760 mg/m$^2$)<br>Test Coupler (1.08 mmol/m$^2$)<br>unsensitized AgBrI emulsion, 6 mol % iodide, with mean particle size 0.5 μm (905 mg/m$^2$ as Ag)<br>saponin at 1.5% melt volume |
| FILMBASE | transparent polyacetate-butyrate |

Test coatings are exposed to white light at 3000 K. for 3 sec through a graduated density test object. These conditions supply an exposure of about 3290 lumens per m$^2$ to the film plane at the clear step of the test object.

The coating is then developed for 120 sec at 38° C. using the developing solution described in British Journal of Photography Annual 1988, pp. 196–198, and set forth below:

| Color Developer (pH 10.0–10.1) | |
|---|---|
| Calgon | 2.0 g |
| Sodium sulfite (anhydrous) | 4.25 g |
| Potassium bromide | 1.5 g |
| Potassium carbonate (anhydrous) | 37.5 g |
| Hydroxylamine sulfate | 2.0 g |
| Water to make | 1000.0 ml |
| Add 6 hours before use: | |

-continued

| Color Developer (pH 10.0–10.1) | |
|---|---|
| CD-4 | 4.75 g |
| or CD-4 (20% solution) | 24.0 ml |

The CD-4 stock solution can be made as follows:

| CD-4 Stock Solution: | |
|---|---|
| CD-4 | 20.0 g |
| Potassium metabisulfite (crystalline) | 3.0 g |
| Water to make | 1000.0 ml |

Development is stopped by treatment for 30 sec in an acidic bath prepared from 10 ml of 18M sulfuric acid diluted to 1 l with water. The coating is then washed for 180 sec in water. Undeveloped silver is removed from the coating by treatment for 240 sec in the fixing bath described in British Journal of Photography Annual 1988, pp. 196–198, and set forth below:

| Fix (pH: 5.8–6.5) | |
|---|---|
| Ammonium thiosulfate | 120.0 g |
| Sodium sulfite (anhydrous) | 20.0 g |
| Potassium metabisulfite (crystalline) | 20.0 g |
| Water to make | 1000.0 ml |

The coating is then washed for an additional 180 sec and then dried.

The amount of silver developed as a function of exposure level is then measured using the x-ray fluorescence technique. Any other known method of silver analysis can be equally well employed. The amount of developed silver then determines whether the coupler is development inhibiting or non-inhibiting. Specifically, the quantity silver developed in the mid-sensitometric range for each test coupler is compared to the quantity of silver developed for a coating incorporating coupler A-9 in Table I. With the specified emulsion, this occurs at an exposure level of about 3.3 lumens per m$^2$. The coatings incorporating coupler A-9 typically develop about one-half of the silver at this exposure level that they develop at maximum exposure under the described processing conditions. If significantly more or less light-sensitive emulsions are used in the test procedure, the exposure level should be accordingly adjusted, in a manner well known to those skilled in the photographic art.

This testing procedure can be followed using other coupler solvents as appropriate for the intended use of the image coupler to be evaluated, again in a manner well known to those skilled in the art.

The above-described testing procedure is carried out using a p-phenylenediamine developing agent. Additionally, similar test procedures can be employed utilizing developing agents other than p-phenylenediamine, for example, hydroquinone, in which no image dye is formed so long as either an inhibited or non-inhibited silver vs log E scale is formed. This modification enables inhibiting and non-inhibiting image couplers to be distinguished even in the absence of a coupling reaction.

The percentage of developed silver is calculated according to the following formula:

$$\frac{\text{(silver developed with test coupler)}}{\text{(silver developed with coupler A-9)}} \times 100$$

Couplers that enable development of at least 80% of the silver developed in the presence of coupler A-9 are classified as intrinsically non-inhibiting (class A). Couplers that enable development of less than 80% of the silver developed in the presence of coupler A-9 are classified as intrinsically development inhibiting (class B).

Table I presents a number of exemplary magenta dye-forming couplers of classes A and B. Test results supporting the classification of these couplers are presented in Table II.

In Table I it is understood that any unsatisfied valencies are supplied by hydrogen (—H).

TABLE I

A) Non-inhibiting Couplers

A-1:

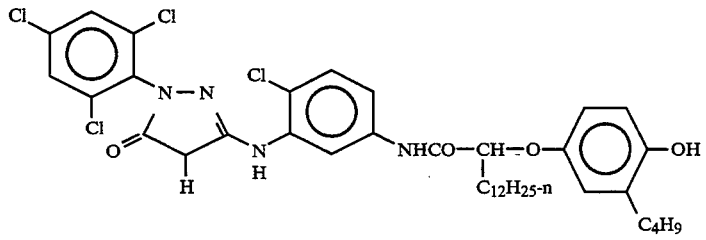

A-2:

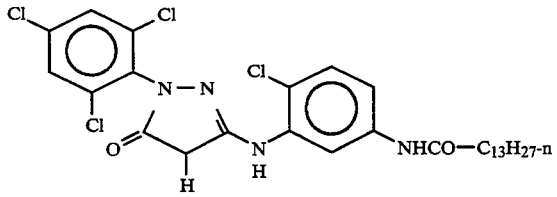

A-3:

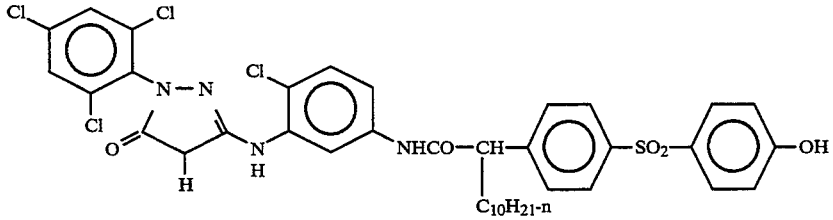

A-4:

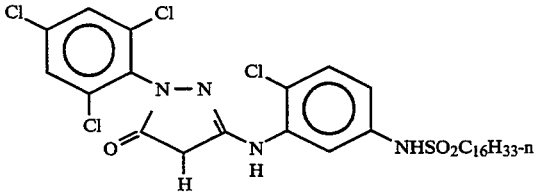

A-5:

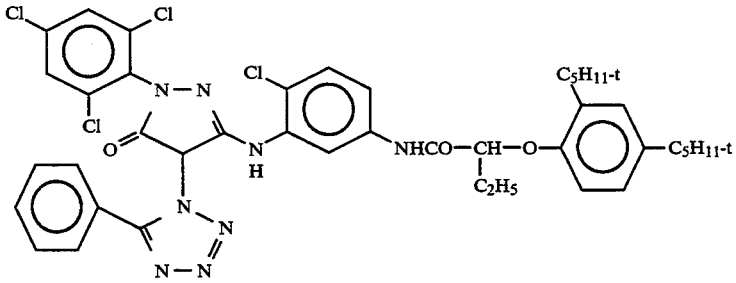

TABLE I-continued
A-6:
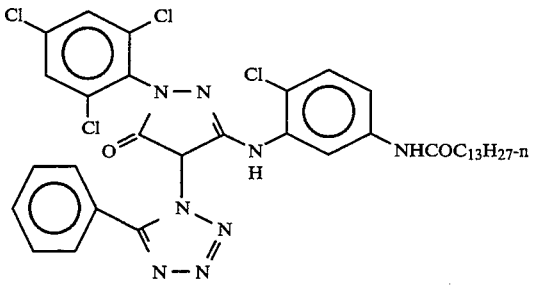
A-7:
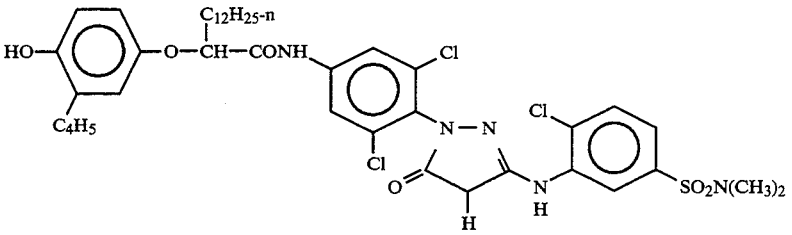
A-8:
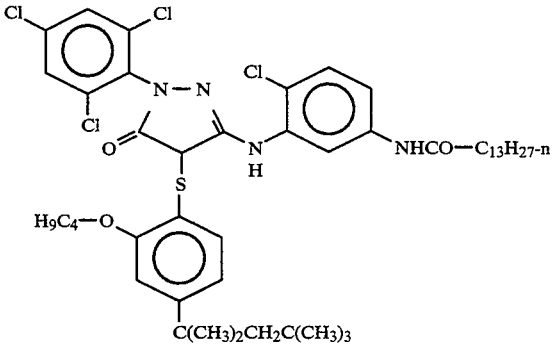
A-9:
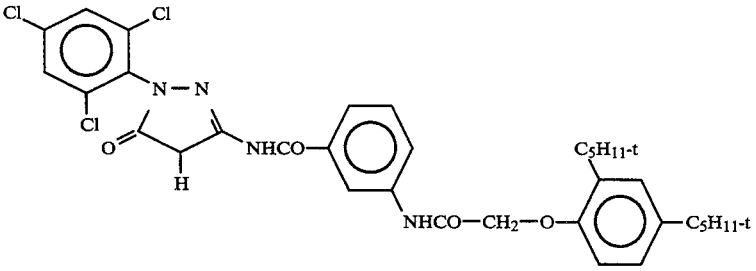
A-10:
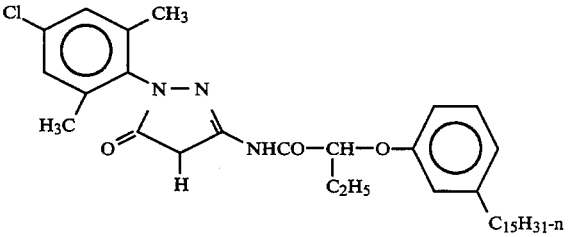

TABLE I-continued
A-11:
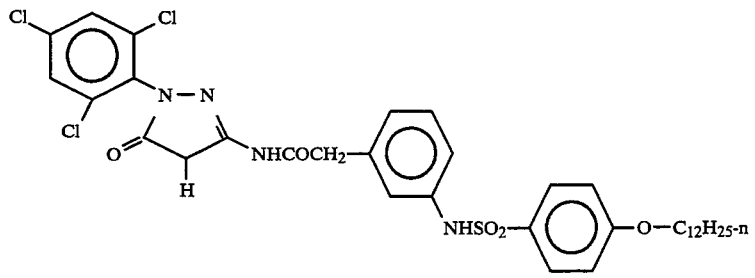
A-12:
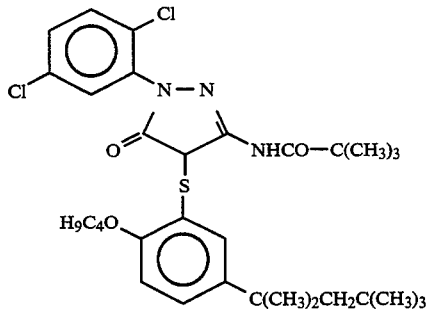
A-13:
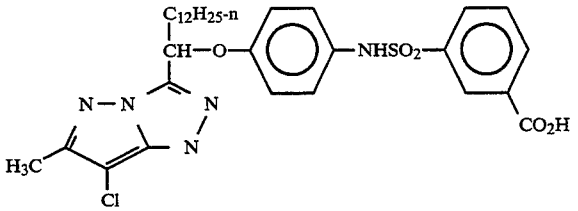
A-14:
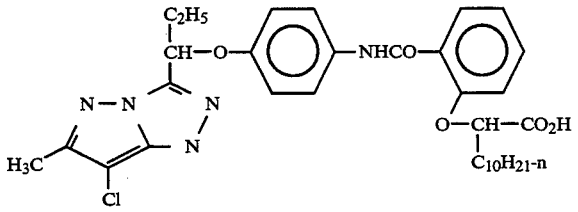
A-15:
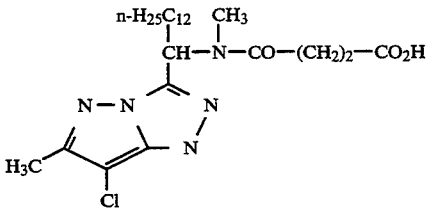
A-16:
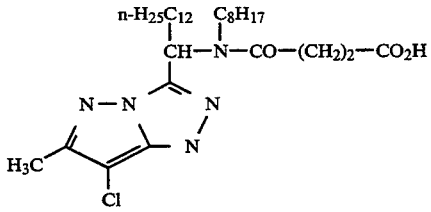

TABLE I-continued
A-17:
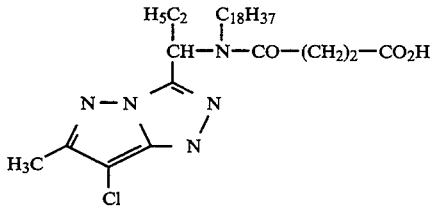
A-18:
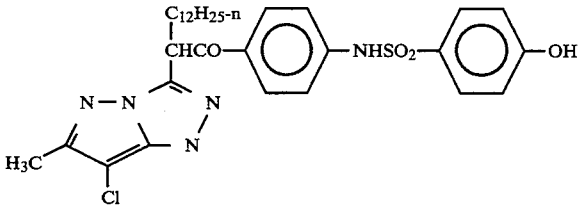
A-19:
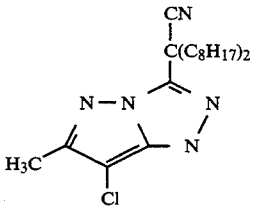
A-20:
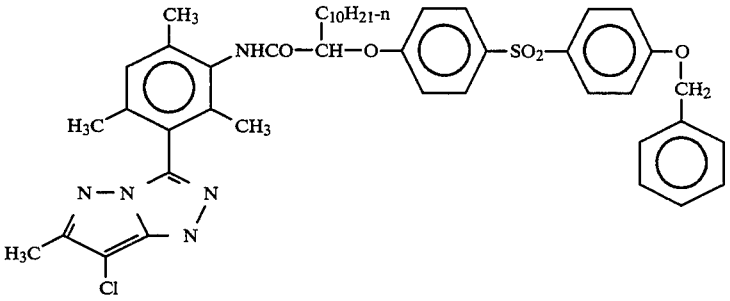
A-21:
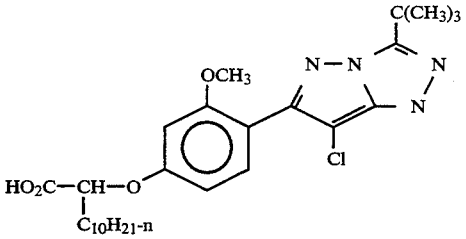
A-22:
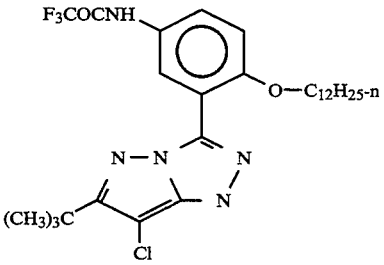

TABLE I-continued
A-23:
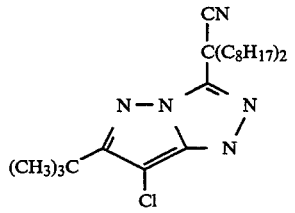
A-24:
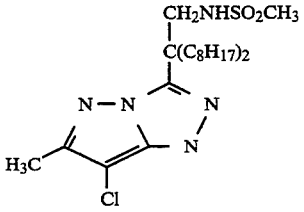
A-25:
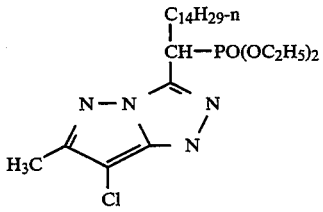
A-26:
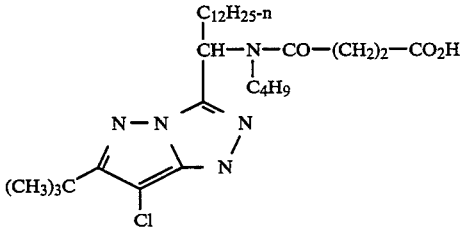
A-27:
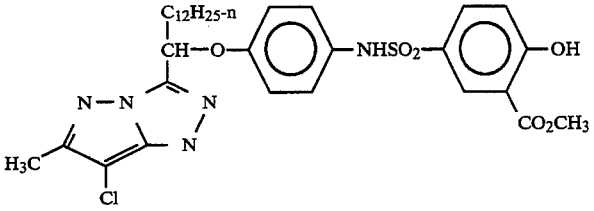
A-28:
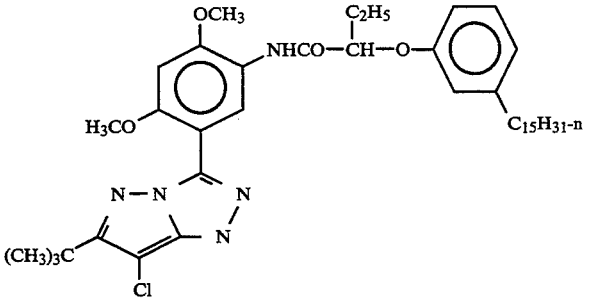
A-29:
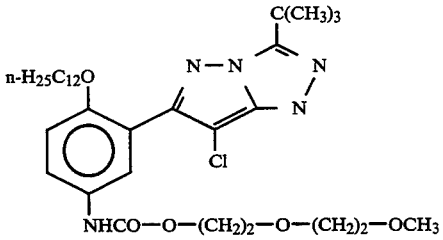

TABLE I-continued
A-30:
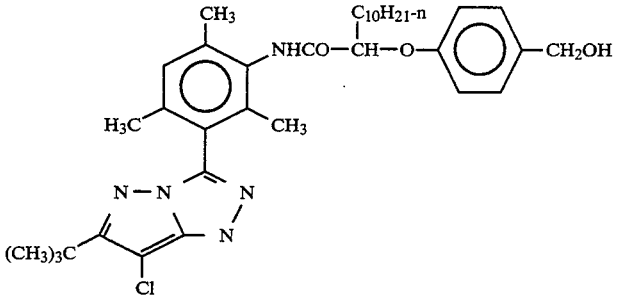
A-31:
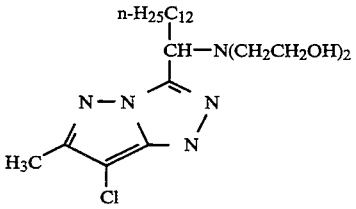
A-32:
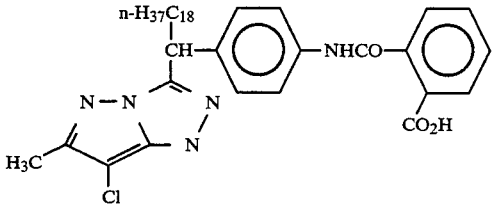
A-33:
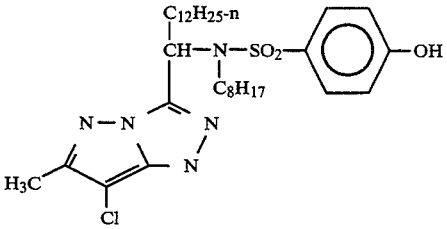
A-34:
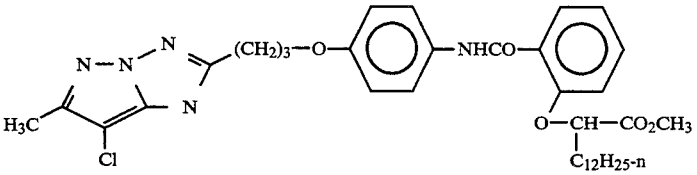
A-35:
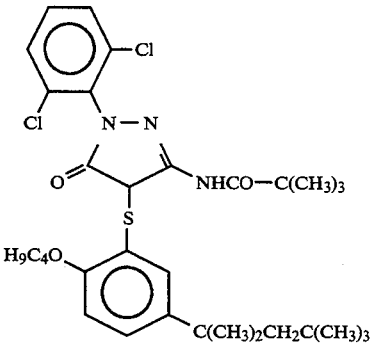

TABLE I-continued
A-36:
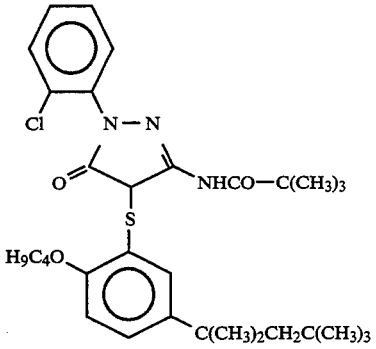
A-37:
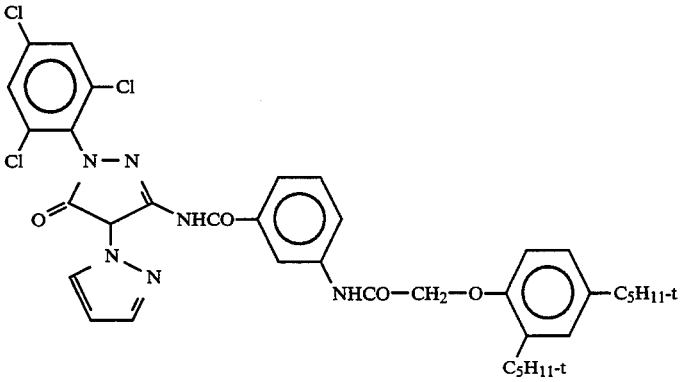
A-38:
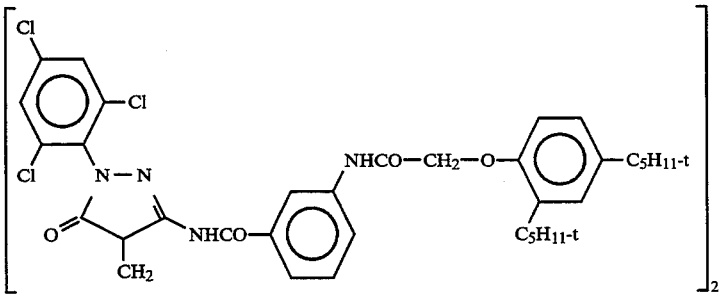
B) Inhibiting Couplers
B-1:
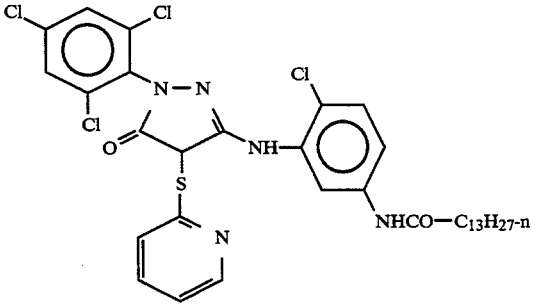
B-2:
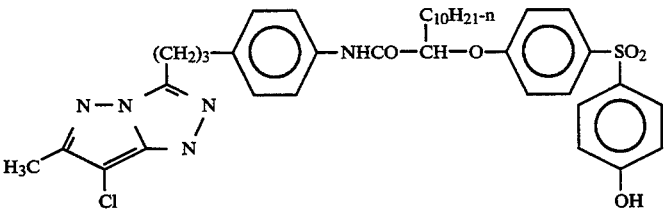

TABLE I-continued
B-3:
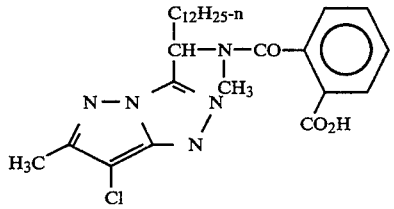
B-4:
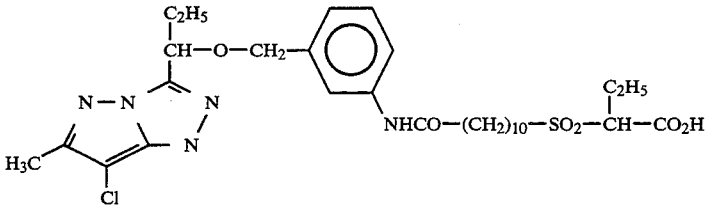
B-5:
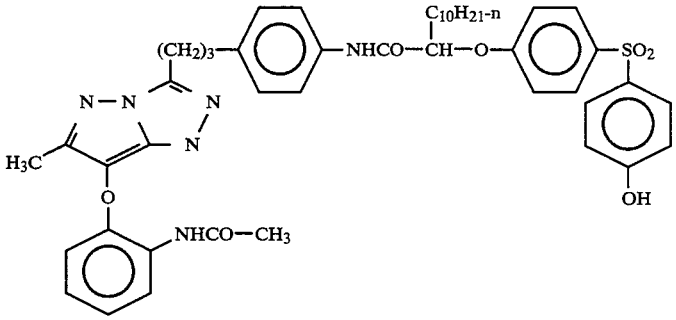
B-6:
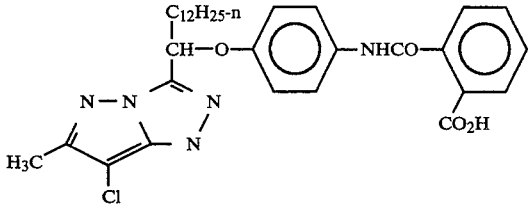
B-7:
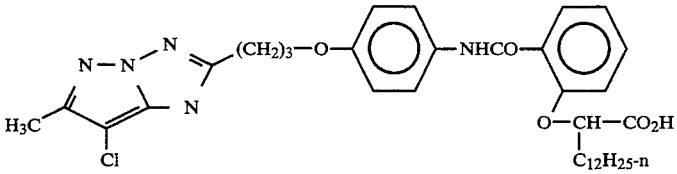
B-8:
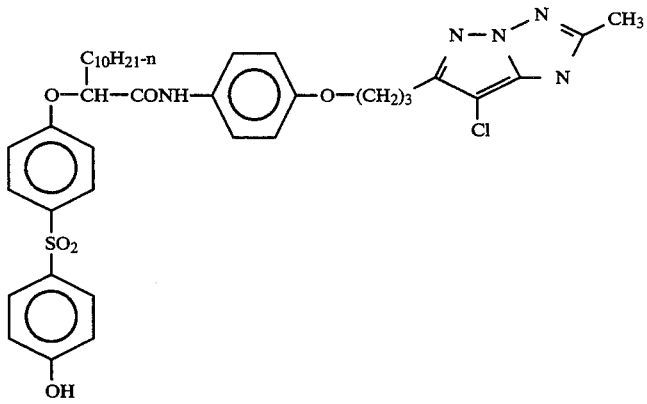

TABLE II

| Coupler | % dev. Ag | Coupler | % dev. Ag |
|---|---|---|---|
| | A) Non-inhibiting Couplers | | |
| A-1 | 93.3 | A-21 | 110.0 |
| A-2 | 91.7 | A-22 | 93.1 |
| A-3 | 93.3 | A-23 | 96.2 |
| A-4 | 104.2 | A-24 | 89.3 |
| A-5 | 80.9 | A-25 | 96.9 |
| A-6 | 85.7 | A-26 | 88.5 |
| A-7 | 90.5 | A-27 | 81.0 |
| A-8 | 116.0 | A-28 | 87.1 |
| A-9* | 100.0 | A-29 | 93.9 |
| A-10 | 95.8 | A-30 | 80.0 |
| A-11 | 110.0 | A-31 | 90.0 |
| A-12 | 100.0 | A-32 | 83.3 |
| A-13 | 104.2 | A-33 | 100.0 |
| A-14 | 93.1 | A-34 | 83.3 |
| A-15 | 96.2 | A-35 | 80.7 |
| A-16 | 104.6 | A-36 | 90.3 |
| A-17 | 100.0 | A-37 | 108.7 |
| A-18 | 89.7 | A-38 | 96.7 |
| A-19 | 95.5 | | |
| A-20 | 93.9 | | |
| | B) Inhibiting couplers | | |
| B-1 | 48.0 | | |
| B-2 | 50.0 | | |
| B-3 | 71.4 | | |
| B-4 | 72.0 | | |
| B-5 | 47.6 | | |
| B-6 | 75.0 | | |
| B-7 | 40.0 | | |
| B-8 | 46.7 | | |

*standard of reference

Examples of additional non-inhibiting image-dye forming couplers are shown below. All such couplers are characterized as non-inhibiting through comparison with the reference coupler A-9 as described above.

C-1

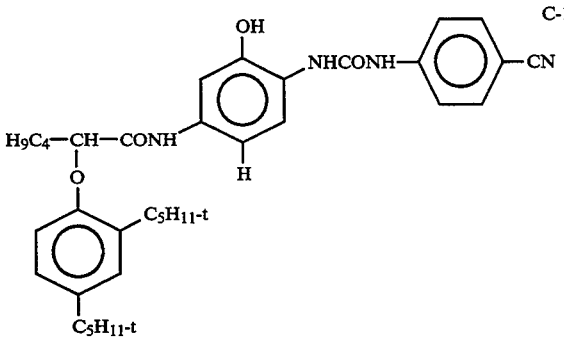

C-2

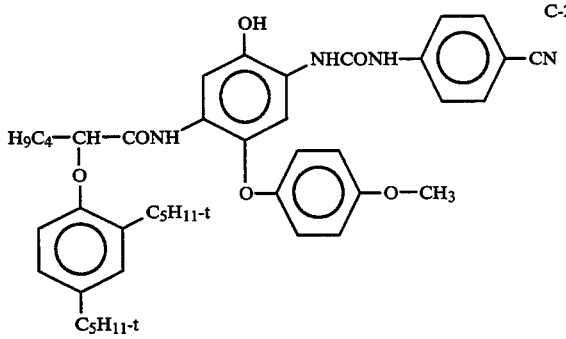

-continued

C-3

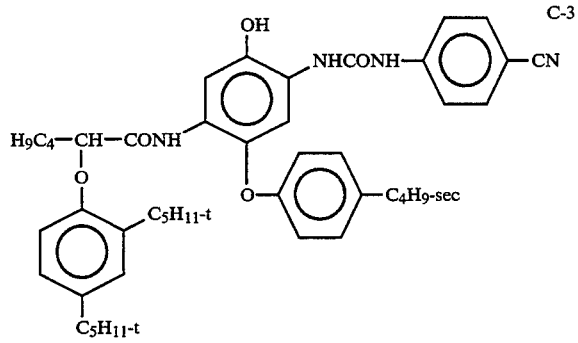

C-4

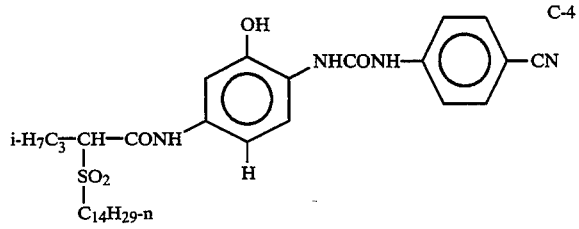

C-5

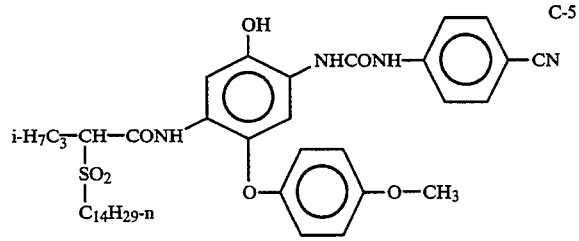

C-6

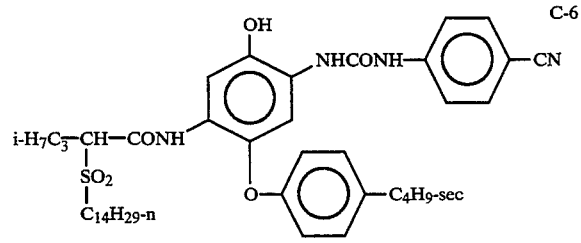

C-7

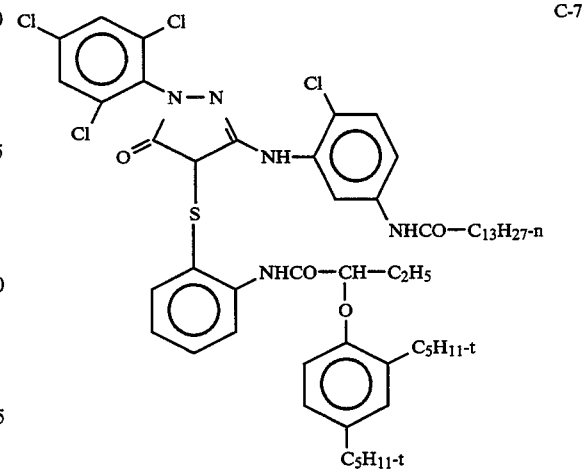

-continued

C-8

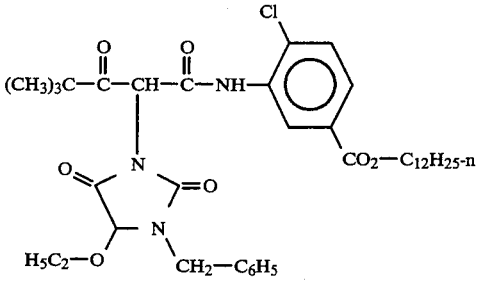

C-9

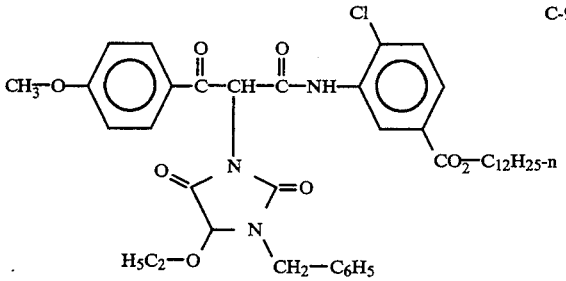

C-10

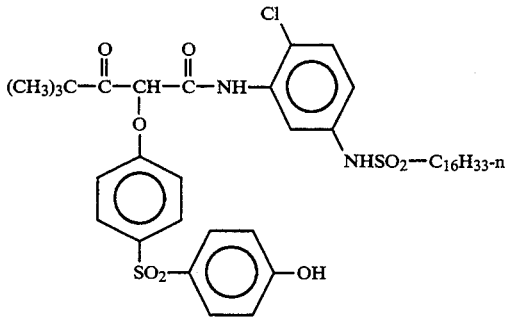

C-11

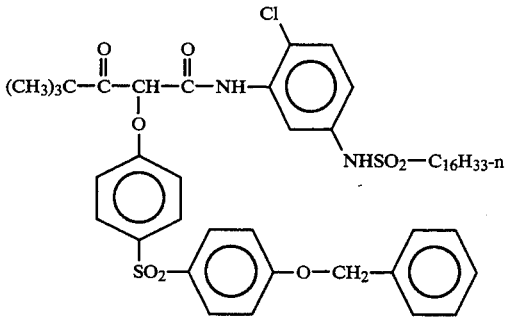

C-12

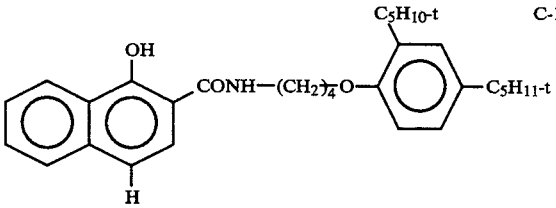

Additional exemplary non-inhibiting and inhibiting magenta dye-forming image couplers are disclosed in EP 0 285 274, corresponding to U.S. Ser. No. 23,518 (R. Romanet et al.), and in U.S. Pat. No. 4,443,536, which are incorporated herein by reference. It is specifically contemplated that any magenta coupler displaying the requisite inhibiting or non-inhibiting behavior can be employed as appropriate in the blends of the instant invention.

The image couplers used according to the invention can be employed in quantities typically known in the photographic art. It is preferred that they be employed at a molar ratio between about 1 mol % and 400 mol % relative to the quantity of silver halide with which they are in reactive association.

In general, any molar ratio of non-inhibiting (class A) image coupler to inhibiting (class B) image coupler can be employed. It is preferred that the molar ratio of non-inhibiting to inhibiting image coupler be between about 19:1 and 1:19, more preferably between about 9:1 and 1:9, and particularly preferably between about 4:1 and 1:4.

The image coupler blends according to the invention can comprise more than one inhibiting (class B) image coupler in combination with a non-inhibiting (class A) image coupler. Likewise, the image coupler blends of the invention can comprise an inhibiting image coupler in combination with more than one non-inhibiting image coupler. Similarly, more than one of each type of coupler can be employed within the scope of the present invention.

The image dye forming couplers of the present invention can be in the same photographic layer as the silver halide emulsion, or they can be in sufficient reactive association with such a layer so as to enable improved image to fog discrimination.

The image dye forming couplers can both form image dyes of similar hue as described in the illustrative examples provided herein. The image dyes formed can be those typically classified as cyan dyes, magenta dyes or yellow dyes. Alternatively, the image dye forming couplers can form image dyes of differing hue and extinction. In one embodiment, it is contemplated that two or more such image dye-forming couplers can be used in reactive association with the same silver halide photographic layer to enable desired color reproduction properties in a color photographic material while providing desired gamma and density formation as well as fog control. In another embodiment, it is contemplated that two or more such image dye-forming couplers which form dyes of different hues can be used to enable the formation of, for example, a black colored chromogenic dye deposit with improved control of image density to fog density.

In a preferred embodiment, at least one of the non-inhibiting (class A) or inhibiting (class B) image dye-forming couplers is a magenta dye-forming coupler. Blends within the scope of the invention are contemplated to include those blends in which the non-inhibiting image dye-forming coupler is a cyan, magenta or yellow dye-forming coupler and the inhibiting image dye-forming coupler Is a magenta dye-forming coupler. The non-inhibiting coupler in such blends can be a phenol coupler, a naphthol coupler, a pyrazolone coupler, a pyrazolotriazole coupler, a pivaloylacetanalide coupler or a benzoylacetanilide coupler. Particularly preferably, the non-inhibiting image dye-forming coupler is a pyrazolotriazole coupler or a pyrazolone coupler, specifically: a pyrazolotriazole having N in positions 1, 2, 4 and 5; a pyrazolotriazole having N in positions 1, 3, 4 and 5; a 1-(aryl)- or 1-(alkyl)-3-acylamino-5-pyrazolone; or a 1-(aryl)- or 1-(alkyl)-3-anilino-5-pyrazolone.

In a preferred embodiment, the inhibiting image dye-forming coupler is a magenta dye-forming coupler, particularly preferably a pyrazolotriazole coupler or a pyrazolone coupler, and specifically: a pyrazolotriazole having N in positions 1, 2, 4 and 5; a pyrazolotriazole having N in positions 1, 3, 4 and 5; or a 1-(aryl)- or 1-(alkyl)-3-anilino-5-pyrazolone.

In one embodiment coupler A-16 is employed in combination with coupler B-2. In another embodiment, the inventive blend comprises an intrinsically non-inhibiting (class A) image dye-forming coupler and an intrinsically inhibiting (class B) image dye-forming coupler, in which class A coupler A-16, set forth above, is not present in combination with class B coupler B-2.

The image dye-forming couplers used in the inventive blends can be unballasted or ballasted with an oil-soluble or fat-tail group. They can be monomeric, or they can form part of a dimeric, oligomeric or polymeric coupler.

It will be appreciated that, depending on the particular coupler moiety, the particular color developing agent and the type of processing, the reaction product of the coupler and oxidized color developing agent can be: (1) colored and non-diffusible, in which case it will remain in the location where it is formed; (2) colored and diffusible, in which case it can be removed during processing from the location where it is formed or allowed to migrate to a different location; or (3) substantially colorless and diffusible or non-diffusible, in which case it will not contribute significantly to image density. In cases (2) and (3) the reaction product can be initially colored and/or non-diffusible but converted into colorless and/or diffusible products during the course of processing.

The image dye-forming couplers of the inventive blends can be incorporated in a photographic element using any of the dispersion and coating techniques known in the art.

The silver development inhibiting (class B) couplers employed according to the invention differ from, and are not to be confused with, development inhibitor releasing compounds known to the photographic art. The two types of compounds differ both in chemical structure and in function.

The development inhibitor releasing (DIR) compounds known to the art can release a development inhibitor moiety or precursor thereof as a function of a coupling reaction with oxidized developer. This release is typically imagewise as a function of exposure and enables development inhibition in an imagewise fashion. The development inhibitor moiety thus released may diffuse to a greater or lesser extent throughout a photographic material and inhibit development in a photographic layer other than one with which the DIR compound itself is in reactive association.

The development inhibiting (class B) image couplers employed in the blends of the instant invention are compounds that are intrinsically, innately development inhibiting. They do not comprise development inhibitor moieties as are typically released by known DIR compounds. The development inhibiting function does not depend on the release of a development inhibitor moiety or a precursor thereof as a function of a coupling reaction with oxidized developer. The development inhibiting function of the class B image couplers used in the invention occurs in a non-imagewise fashion and inhibits development only in the photographic layer with which the class B couplers are in reactive association.

The image coupler blends of the present invention can, however, be used in combination with the known DIR compounds.

In the following discussion of suitable materials for use in the elements and emulsions according to the invention, reference will be made to *Research Disclosure*, December 1989, Item 308119, published by Kenneth Mason Publications Ltd., Emsworth, Hampshire PO10 7DQ, U.K., the disclosures of which are incorporated in their entireties herein by reference. This publication will be identified hereafter as "Research Disclosure".

The support of the element of the invention can be any of a number of well known supports for photographic elements. These include polymeric films, such as cellulose esters (for example, cellulose triacetate and diacetate) and polyesters of dibasic aromatic carboxylic acids with divalent alcohols (such as polyethylene terephthalate), paper, and polymer-coated paper.

The photographic elements according to the invention can be coated on the selected supports as described in Research Disclosure Section XVII and the references cited therein.

The radiation-sensitive layer of a photographic element according to the invention can contain any of the known radiation-sensitive materials, such as silver halide, or other light sensitive silver salts. Silver halide is preferred as a radiation-sensitive material. It is particularly preferred that the silver halide emulsions employed according to the invention contain silver bromide, silver iodide, silver bromoiodide, or mixtures thereof. The emulsions can include coarse, medium, or fine silver halide grains bounded by 100, 111, or 110 crystal planes.

The silver halide emulsions employed in the elements according to the invention can be either negative-working or positive-working. Suitable emulsions and their preparation are described in Research Disclosure Sections I and II and the publications cited therein.

Especially useful are tabular grain silver halide emulsions.

In general, tabular grain emulsions are those in which greater than 50 percent of the total grain projected area comprises tabular grain silver halide crystals having a grain diameter and thickness selected so that the diameter divided by the mathematical square of the thickness is greater than 25, wherein the diameter and thickness are both measured in microns. An example of tabular grain emulsions is described in U.S. Pat. No. 4,439,520.

These high aspect ratio tabular grain silver halide emulsions and other emulsions useful in the practice of the instant invention can be characterized by geometric relationships, specifically the Aspect Ratio and the Tabularity. The Aspect Ratio (AR) and the Tabularity (T) are defined as follows:

$$AR = \frac{\text{Equivalent Circular Diameter}}{\text{Thickness}}$$

$$T = \frac{\text{Aspect Ratio}}{\text{Thickness}}$$

where the equivalent circular diameter and thickness of the grains, measured using methods known to those skilled in the art, are expressed in microns.

High AR tabular grain emulsions useful in practicing the instant invention preferably have an AR greater than about 3, and particularly preferably have an AR greater than about 10. These emulsions additionally can be characterized in that their T is greater than about 25, and preferably exceeds about 50.

High aspect ratio tabular grain emulsions are specifically contemplated for at least one layer of the photographic elements according to the invention. Examples of such emulsions are those disclosed by Mignot, U.S. Pat. No. 4,386,156; Wey, U.S. Pat. No. 4,399,215; Maskasky, U.S. Pat. No. 4,400,463; Wey et al., U.S. Pat. No. 4,414,306; Maskasky, U.S. Pat. No. 4,414,966; Daubendiek et al., U.S. Pat. No. 4,424,310; Solberg et al., U.S. Pat. No. 4,433,048; Wilgus et al., U.S. Pt. No. 4,434,226; Maskasky, U.S. Pat. No. 4,435,501; Evans et al., U.S. Pat. No. 4,504,570; Maskasky, U.S. Pat. No. 4,643,966; and Daubendiek et al., U.S. Pat. Nos. 4,672,027 and 4,693,964. Also specifically contemplated are those silver bromoiodide grains with a higher molar proportion of iodide in the core of the grain than in the periphery of the grain, such as those described in U.K. Patent No. 1,027,146; Japanese Patent 54/48521; U.S. Pat. Nos. 4,379,837; 4,444,877; 4,565,778; 4,636,461; 4,665,012; 4,668,614; 4,686,178; and 4,728,602; and in European Patent 264,954. The silver halide emulsions can be either monodisperse or polydisperse as precipitated. The grain size distribution of the emulsions can be controlled by silver halide grain separation techniques or by blending silver halide emulsions of differing grain sizes.

Suitable vehicles for the emulsion layers and other layers of elements according to the invention are described in Research Disclosure Section IX and the publications cited therein.

The radiation-sensitive materials described above can be sensitized to a particular wavelength range of radiation, such as the red, blue, or green portions of the visible spectrum, or to other wavelength ranges, such as ultraviolet, infrared, X-ray, and the like. Sensitization of silver halide can be accomplished with chemical sensitizers such as gold compounds, iridium compounds, or other group VIII metal compounds, or with spectral sensitizing dyes such as cyanine dyes, merocyanine dyes, or other known spectral sensitizers. Exemplary sensitizers are described in Research Disclosure Section IV and the publications cited therein.

Multicolor photographic elements according to the invention generally comprise a blue-sensitive silver halide layer having a yellow color-forming coupler associated therewith and a red-sensitive silver halide layer having a cyan color-forming coupler associated therewith, as well as a green-sensitive layer having the inventive blend of color-forming couplers, preferably magenta color-forming couplers, associated therewith. Color photographic elements and color-forming couplers are well-known in the art.

As used herein, the term "associated therewith" signifies that the image coupler is in a silver halide emulsion layer or in an adjacent location where, during processing, it will come into reactive association with silver halide development products. The elements according to the invention can include couplers as described in Research Disclosure Section VII, paragraphs D, E, F and G and the publications cited therein. These couplers can be incorporated in the elements and emulsions as described in Research Disclosure Section VII, paragraph C and the publications cited therein. Blends of both inhibiting and non-inhibiting image couplers can be chosen according to the invention from among the image dye-forming couplers desclosed herein.

A photographic element according to the invention, or individual layers thereof, can also include any of a number of other well-known additives and layers. These include, for example, optical brighteners (see Research Disclosure Section V), antifoggants and image stabilizers (see Research Disclosure Section VI), light-absorbing materials such as filter layers of intergrain absorbers, and light-scattering materials (see Research Disclosure Section VIII), gelatin hardeners (see Research Disclosure Section X), oxidized developer scavengers, coating aids and various surfactants, overcoat layers, interlayers, barrier layers and antihalation layers (see Research Disclosure Section VII, paragraph K), antistatic agents (see Research Disclosure Section XIII), plasticizers and lubricants (see Research Disclosure Section XII), matting agents (see Research Disclosure Section XVI), antistain agents and image dye stabilizers (see Research Disclosure Section VII, paragraphs I and J), development-inhibitor releasing couplers and bleach accelerator-releasing couplers (see Research Disclosure Section VII, paragraph F), development modifiers (see Research Disclosure Section XXI), and other additives and layers known in the art.

The photographic elements according to the invention can advantageously comprise DIR compounds known to those skilled in the art. Typical examples of DIR compounds, their preparation and methods of incorporation in photographic materials are disclosed in U.S. Pat. Nos. 4,756,600 and 4,855,220, as well as by commercially available materials. Other examples of useful DIR compounds are disclosed in Research Disclosure Section VII-F.

These DIR compounds can be incorporated in the same layer as the image coupler blends of the invention, in reactive association with this layer or in a different layer of the photographic material, all as known in the art.

These DIR compounds can be among those classified as "diffusible," meaning that they enable release of a highly transportable inhibitor moiety, or among those classified as "non-diffusible," meaning that they enable release of a less transportable inhibitor moiety. The DIR compounds can comprise a timing or linking group as known to the art. Exemplary timing groups are disclosed in U.S. Pat. Nos. 4,248,962, 4,772,537 and 5,019,492.

The inhibitor moiety of the DIR compound may be unchanged as the result of exposure to photographic processing solutions. However, the inhibitor moiety can change in structure and effect in the manner disclosed in U.K. Patent 2,099,167, European Patent Application 167,168, Japanese Kokai 205150/83, or U.S. Pat. No. 4,782,012 as the result of photographic processing.

When DIR compounds are dye-forming couplers, they can be incorporated in reactive association with complementary color sensitized silver halide emulsions, as for example a cyan dye-forming DIR coupler with a red sensitized emulsion, or in a mixed mode, as for example a yellow dye-forming DIR coupler with a green sensitized emulsion, all as known in the art.

The DIR compounds can also be incorporated in reactive association with bleach accelerator releasing couplers as disclosed in U.S. Pat. No. 4,912,024, and in U.S. application Ser. No. 07/563,725, filed Aug. 8, 1990, now U.S. Pat. No. 5,135,839, and 07/612,341, filed Nov. 13, 1990.

Specific DIR compounds useful in the practice of the instant invention are disclosed in the references cited above, in commercial use and in the examples demonstrating the practice of the invention, below. Additional useful DIR compounds are shown below:

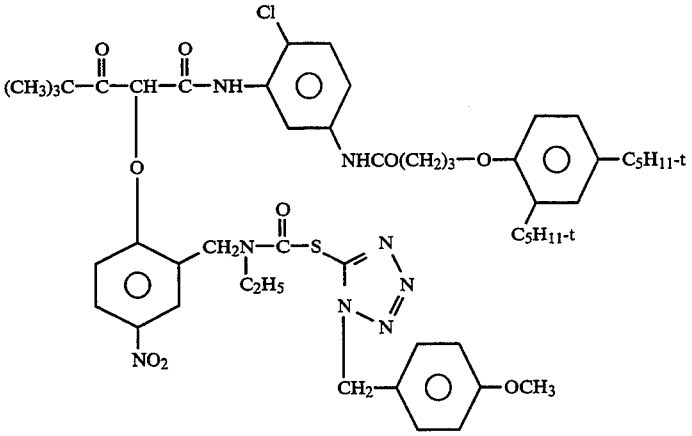
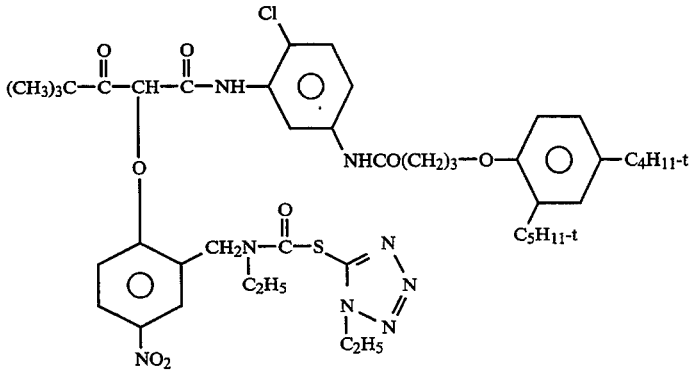
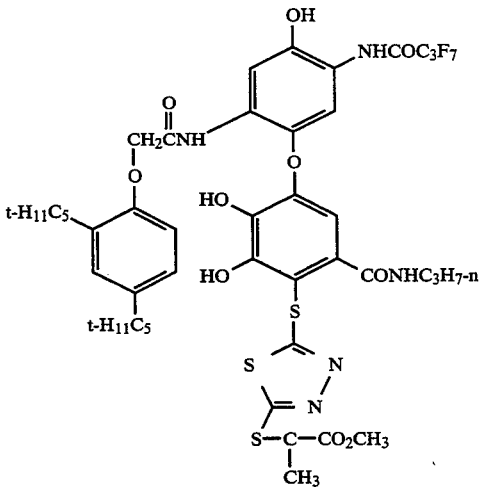

-continued
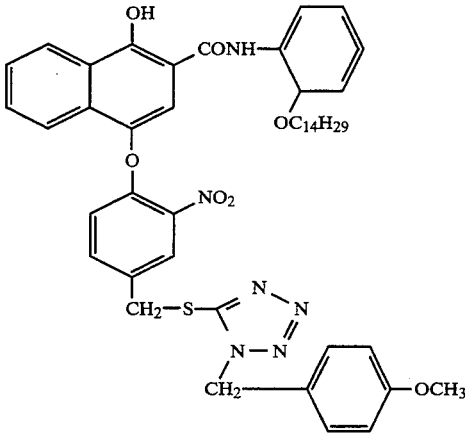
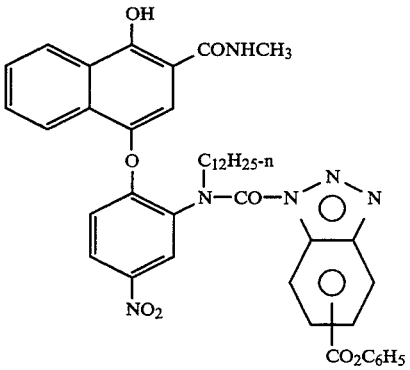
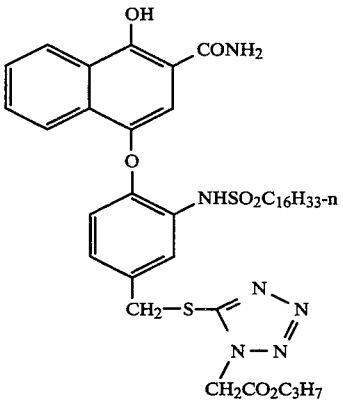
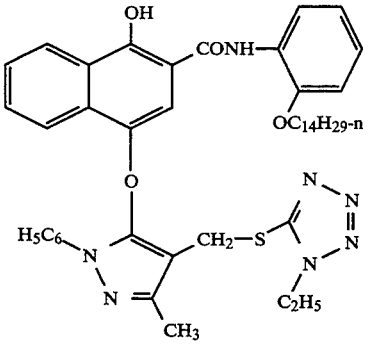

-continued
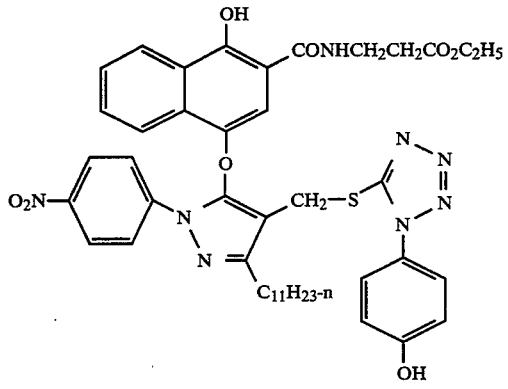
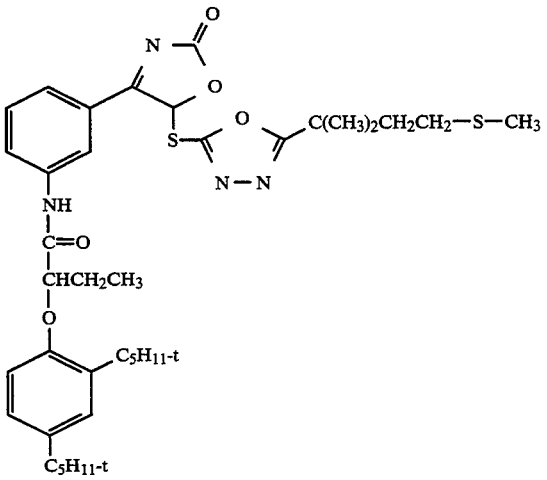
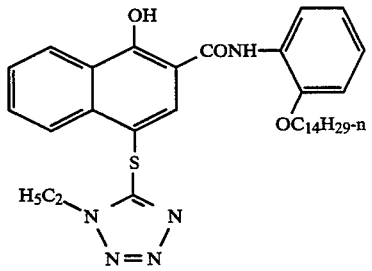
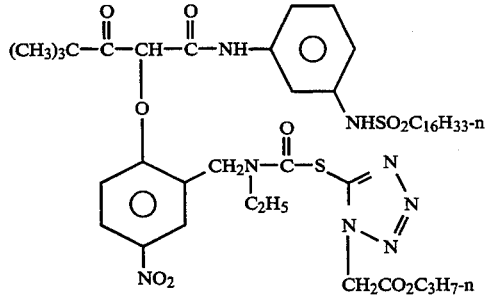

-continued
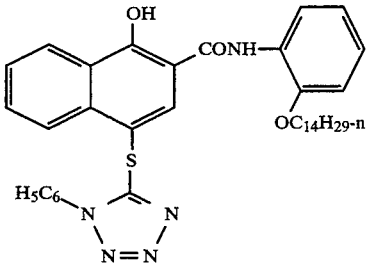
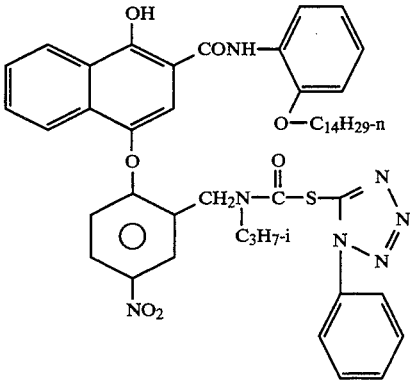
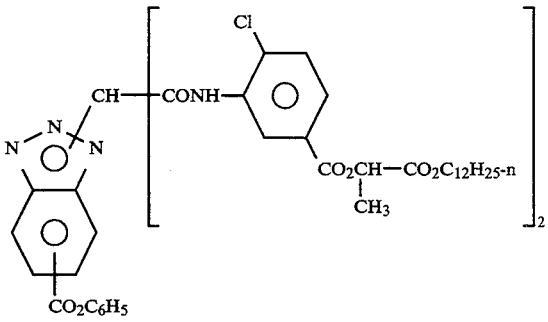
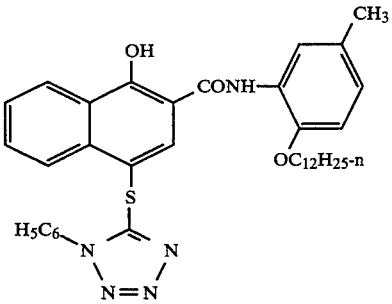
The photographic elements of the invention can also comprise Bleach Accelerator Releasing (BAR) compounds, as described in European Patents 0 193 389 B and 0 310 125, and in U.S. Pat. No. 4,842,994, and BAR silver salts as described in U.S. Pat. Nos. 4,865,956 and 4,923,784. Typical structures of such useful compounds include:
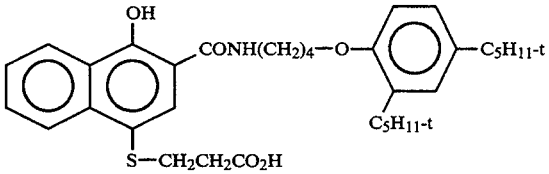

-continued

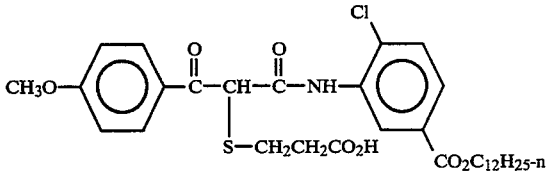

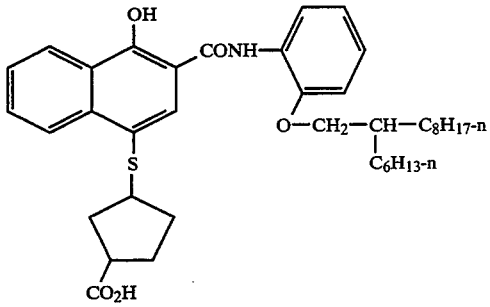

$Ag—S—CH_2CH_2CO_2H$

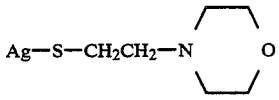

Photographically useful compounds, such as those described above, can be incorporated in blocked form. Preferred blocked compounds are described in U.S. Pat. No. 5,019,492.

Photographic elements according to the invention can be exposed to actinic radiation, typically in the visible region of the spectrum, to form a latent image as described in Research Disclosure Section XVIII, and then processed to form a visible dye image as described in Research Disclosure Section XIX. Processing can be any type of known photographic processing.

A negative image can be developed by known color development methods. A positive image can be developed by first developing with a nonchromogenic developer, then uniformly fogging the element, and then developing by a known process. If the material does not contain a color-forming coupler compound, dye images can be produced by incorporating a coupler in the developer solutions.

Development is followed by the conventional steps of bleaching, fixing, or bleach-fixing, to remove silver and silver halide, washing and drying. Bleaching and fixing can be performed with any of the materials known to be used for that purpose. Bleach baths generally comprise an aqueous solution of an oxidizing agent such as water soluble salts and complexes of iron (III) (such as potassium ferricyanide, ferric chloride, ammonium or potassium salts of ferric ethylenediaminetetraacetic acid or ferric 1,3-propylenediaminetetraacetic acid), water-soluble dichromates (such as potassium, sodium, and lithium dichromate), and the like. Fixing baths generally comprise an aqueous solution of compounds that form soluble salts with silver ions, such as sodium thiosulfate, ammonium thiosulfate, potassium thiocyanate, sodium thiocyanate, thioureas, and the like.

The invention is further illustrated by the following examples, without being limited thereby.

EXAMPLE 1

Color photographic materials for color negative development were prepared by applying the following layers to a transparent cellulose acetate support.

| | |
|---|---|
| DOC | Gelatin (1612 mg/m$^2$) |
| | hardener H-1 (1.8% of total gelatin) |
| GREEN-SENSITIVE LAYER | Gelatin (2150 mg/m$^2$) |
| | Magenta dye-forming image coupler |
| | Green sensitized emulsion Y |
| | or |
| | Green sensitized emulsion Z |
| | optional DIR compound D-2 |
| | stabilizer (3 g/mol Ag) |
| INTERLAYER | Gelatin (645 mg/m$^2$) |
| | Oxidized developer scavenger S-1 (107 mg/m$^2$) |
| RED-SENSITIVE LAYER | Gelatin (3440 mg/m$^2$) |
| | Cyan dye-forming image coupler R-1 (dispersed in di-n-butyl phthalate) (1720 mg/m$^2$) |
| | DIR compound D-1 (dispersed in N-n-butyl acetanalide) (86 mg/m$^2$) |
| | Red sensitized emulsion A |
| | Red sensitized emulsion B |
| | Red sensitized emulsion C |
| | stabilizer (3 g/mol Ag) |
| ANTIHALATION LAYER | Gelatin (2440 mg/m$^2$) |
| | Black colloidal silver sol (236 mg/m$^2$) |
| FILMBASE | transparent cellulose acetate |

Emulsion Y: green sensitized AgBrI emulsion, 4.5 mol % iodide, with average grain diameter 1.5 μm, average grain thickness 0.15 μm (1612 mg/m$^2$ as Ag)

Emulsion Z: green sensitized AgBrI emulsion, 4.0 mol % iodide, with average grain diameter 2.1 μm, average grain thickness 0.10 μm (1612 mg/m$^2$ as Ag)

Emulsion A: red sensitized AgBrI emulsion, 3.0 mol % iodide, average grain diameter 0.6 μm (215 mg/m$^2$ as Ag)

Emulsion B: red sensitized AgBrI emulsion, 4.5 mol % iodide, average grain diameter 1.2 μm (860 mg/m$^2$ as Ag)

Emulsion C: red sensitized AgBrI emulsion, 4.0 mol % iodide, average grain diameter 2.3 μm (1075 mg/m$^2$ as Ag)

stabilizer: 4-hydroxy-6-methyl-1,3,3a,7-tetraazaindene

D-1:

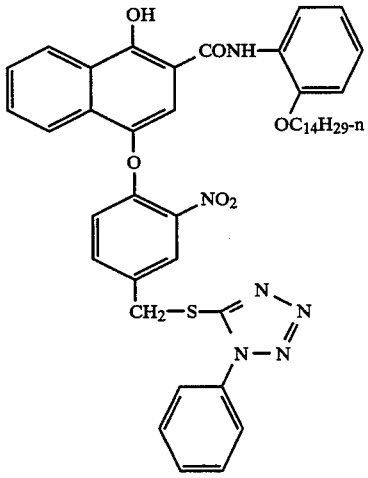

D-2:

-continued

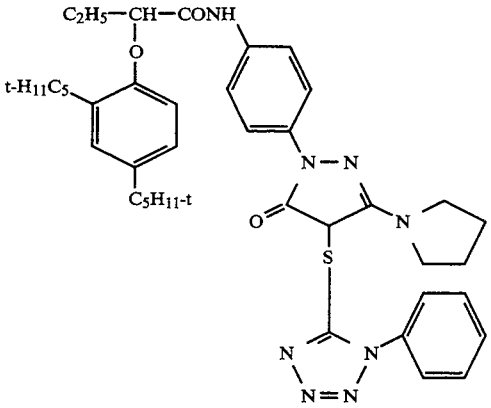

H-1:

$CH_2{=}CH{-}SO_2{-}CH_2{-}O{-}CH_2{-}SO_2{-}CH{=}CH_2$

R-1:

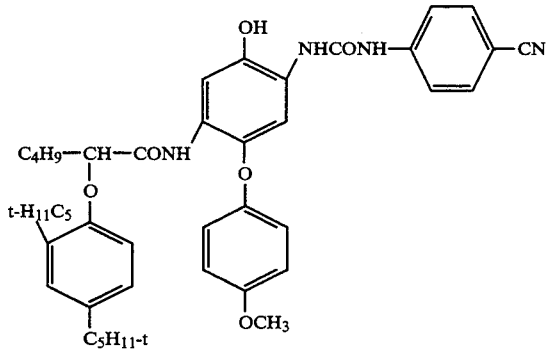

S-1:

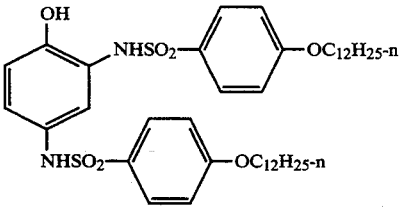

The magenta couplers, green sensitive emulsions and optional DIR compounds used in each photographic element are listed in Tables III and IV. All samples incorporate equimolar quantities of magenta dye-forming image coupler in the green-sensitive layer.

Samples 1-1 through 1-10 were exposed through a Kodak Wratten 9 filter and a graduated density test object using a Kodak IB sensitometer so as to provide a green light exposure, and developed using a C-41 color negative process as described in British Journal of Photography Annual 1988, pages 196–98. Table III lists the Status M green Dmin, gamma and Dmax values for each sample, together with the expected values (calculated as weighted averages) for the various coupler combinations. The unexpected improvements in gamma and Dmax observed with the combinations according to the invention are also shown.

The unexpected increase in gamma and Dmax allows for superior image/fog discrimination in color negative film.

Samples 2-1 through 2-10 were prepared identically to samples 1-1 through 1-10, but with the addition of DIR compound D-2 to the green-sensitive layer in the stated amount. The samples were exposed to white light or green light through a graduated density test object and processed as described above. Table IV lists the Status M green gamma obtained after either a white light (neutral) or green light (Kodak Wratten 9 filtered, green separation) exposure. The experimentally observed red-onto-green Interlayer Interimage Effects (as defined in U.S. Pat. No. 4,840,880, at col. 14, lines 23–25), and the expected values for each of the quantities based on linear interpolation from the values observed for the individual couplers, are shown. The experimental values obtained for the inventive combinations are unexpectedly lower than those that can be obtained with either image coupler when used alone.

TABLE III

| # | Coupler(s) (mg/m²) | Emulsion | Experimental $D_{min}$ | Experimental Gamma | Experimental $D_{max}$ | Expected $D_{min}$ | Expected Gamma | Expected $D_{max}$ | Difference $D_{min}$ | Difference Gamma | Difference $D_{max}$ |
|---|---|---|---|---|---|---|---|---|---|---|---|
| (C)1-1 | B-2 (497) | Y | 0.23 | 1.40 | 2.24 | — | — | — | — | — | — |
| (C)1-2 | A-16 (390) | Y | 0.29 | 2.50 | 2.82 | — | — | — | — | — | — |
| (I)1-3 | A-16 (97)<br>B-2 (372) | Y | 0.24 | 1.94 | 2.56 | 0.245 | 1.68 | 2.38 | ~0 | +0.26 | +0.18 |
| (I)1-4 | A-16 (195)<br>B-2 (248) | Y | 0.26 | 2.20 | 2.72 | 0.26 | 1.95 | 2.58 | 0 | +0.25 | +0.19 |
| (I)1-5 | A-16 (292)<br>B-2 (124) | Y | 0.26 | 2.42 | 2.82 | 0.275 | 2.22 | 2.68 | ~−0.01 | +0.20 | +0.14 |
| (C)1-6 | A-16 (195<br>A-19 (195) | Y | 0.26 | 1.68 | 2.12 | 0.26 | 1.73 | 2.28 | 0 | −0.05 | −0.16 |
| (C)1-7 | A-19 (290) | Y | 0.23 | 0.96 | 1.74 | — | — | — | — | — | — |
| (C)1-8 | B-2 (497) | Z | 0.24 | 1.80 | 2.33 | — | — | — | — | — | — |
| (C)1-9 | A-16 (390) | Z | 0.29 | 2.72 | 2.82 | — | — | — | — | — | — |
| (I)1-10 | A-16 (195)<br>B-2 (248) | Z | 0.26 | 2.46 | 2.75 | 0.285 | 2.26 | 2.58 | ~0 | +0.20 | +0.17 |

TABLE IV

| # | DIR-2 (mg/m²) | Gamma G/G[a] | Gamma G/N[b] | IIE[c] Experimental | IIE[c] Expected | Difference |
|---|---|---|---|---|---|---|
| 2-1 | 15.0 | 1.22 | 0.70 | 0.74 | — | — |
| 2-2 | 38.7 | 1.69 | 1.16 | 0.46 | — | — |
| 2-3 | 20.9 | 1.41 | 0.90 | 0.56 | 0.67 | 0.11 |
| 2-4 | 26.9 | 1.38 | 1.00 | 0.38 | 0.60 | 0.22 |
| 2-5 | 32.8 | 1.23 | 0.96 | 0.28 | 0.53 | 0.25 |
| 2-6 | 22.6 | 1.00 | 0.75 | 0.36 | 0.34 | −0.02 |
| 2-7 | 6.5 | 0.75 | 0.64 | 0.22 | — | — |
| 2-8 | 15.0 | 1.30 | 0.70 | 0.85 | — | — |
| 2-9 | 38.0 | 1.82 | 1.35 | 0.34 | — | — |

TABLE IV-continued

| # | DIR-2 (mg/m²) | Gamma G/G[a] | Gamma G/N[b] | IIE[c] Experimental | IIE[c] Expected | Difference |
|---|---|---|---|---|---|---|
| 2-10 | 26.9 | 1.41 | 0.95 | 0.48 | 0.60 | 0.12 |

[a]Green gamma after a green light exposure
[b]Green gamma after a white light exposure
[c]Interlayer Interimage Effect = $\frac{[G/G - G/N]}{G/N}$

EXAMPLE 2

The granularity improvement obtained with blends of image couplers showing non-inhibiting (class A) and inhibiting (class B) behavior is based on the following photographic test:

The image couplers to be evaluated are typically dispersed with one-half their weight of tricresyl phosphate in gelatin following procedures well-known to those skilled in the photographic art. The dispersion containing the image coupler is then incorporated in a photographic element by applying the following layers in the sequence shown:

| | |
|---|---|
| OC | Gelatin (861 mg/m²)<br>hardener H-1 (1.75% of total gelatin)<br>TX200 (0.75% of total melt volume)<br>Olim 10G (0.25% of total melt volume) |
| EMULSION LAYER | Gelatin (3229 mg/m²)<br>Coupler, total (1.798 mmol/m²)<br>Green sensitized AgBrI emulsion, 0.1 mol % iodide, with average grain diameter 0.274 μm, average grain thickness 0.08 μm (807.3 mg/m² as Ag) |
| FILMBASE | transparent polyacetate-butyrate |

The total moles of coupler was constant but the mole ratio of Class A coupler to Class B coupler varied from 4:1 to 1:4. Blends were obtained with Class A couplers A-13 or A-16 and Class B coupler B-2.

Test coatings are exposed through a graduated density test object to white light at 5500 K. using a Kodak Wratten No. 9 filter and 0.30 neutral density filter. The exposure time was 0.01 sec. The coating is then developed for 195 sec at 38° C. using the known C-41 color process as described, for example, British Journal of Photography Annual 1988, pp. 196–98. The developed silver is removed in a 240 sec bleaching treatment, washed for 180 sec, and the residual silver salts are removed from the coating by a treatment for 240 sec in the fixing bath. The developed silver scale is obtained by omitting the bleaching step.

The amount of developed silver as a function of exposure level is measured using x-ray fluorescence spectroscopy. The granularity of the image dye scale is obtained by measuring the fluctuations in density of a uniform density patch with a 48 μm scanning aperture. The root mean square of these density fluctuations is obtained. Additionally, the average density of each step of the exposure is obtained and used to obtain a density v. log E plot. The instantaneous contrast is obtained for each step and used to normalize the RMS granularity to a common contrast of 1.0.

The results of the testing are given below:

TABLE V

| Coupler (%) | Developed Ag at Midscale (mg/m²) | Gamma Normalized RMS granularity * 1000 |
|---|---|---|
| B-2 (100%) | 172 | 47.2 |
| A-13 (40%)<br>B-2 (60%) | 253 | 38.8 |
| A-13 (100%) | 338 | 35.1 |
| B-2 (100%) | 188 | 50.8 |
| A-16 (40%)<br>B-2 (60%) | 242 | 36.9 |
| A-16 (100%) | 312 | 34.3 |

The significant improvement in gamma normalized grain for the coupler blends versus the Class B coupler alone is realized at a rate that is faster than would have been expected based the addition of Class A coupler.

In one embodiment, a photographic element of the invention may include the coupler combination of the invention in the midsensitivity green layer of a three layer green pack of a multicolor element. Specifically the layer may contain

| mg/m2 | layer component |
|---|---|
| 969 | Green sensitized silver iodobromide emulsion (3% iodide, tabular grains with average grain diameter 0.8 micron and average grain thickness 0.1 micron) |
| 75.0 | Magenta dye-forming image coupler (B-2) |
| 54.0 | Magenta dye-forming image coupler (A-16) |
| 9.0 | Magenta dye-forming DIR coupler (D-2) |
| 11.0 | Cyan dye forming, image coupler (CD) |
| 1238 | Gelatin |

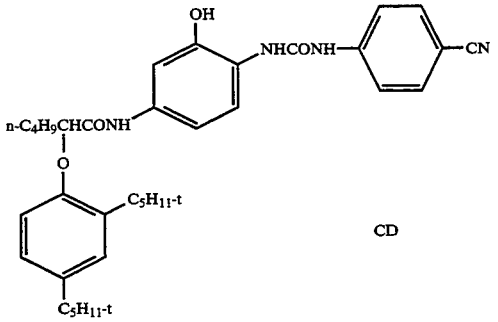

CD

It is to be understood that the foregoing detailed description and specific examples, while indicating preferred embodiments of the present invention, are given by way of illustration and not limitation. Many changes and modifications within the scope of the present invention may be made without departing from the spirit thereof and the invention includes all such modifications.

What is claimed is:

1. A photographic element comprising a support, a silver halide emulsion, a first image dye-forming coupler which does not intrinsically inhibit development of said silver halide, and a second image dye-forming coupler which intrinsically inhibits development of said silver halide, said first and second image dye-forming couplers being in reactive association with said silver halide emulsion, wherein said first image-dye forming coupler enables development of at least 80% of the silver developed in the presence of coupler A-9, and wherein said second image dye-forming coupler is not a development inhibitor releasing coupler and enables development of less than 80% of the silver developed in the presence of coupler A-9, with the proviso that said first image-dye forming coupler is selected from the group consisting of couplers A-1 to A-38 and C-1 to C-12 and/or with the proviso that said second image-dye forming coupler is selected from the group consisting of B-1 to B-8.

2. A photographic element as claimed in claim 1, wherein at least one of said first and second image dye-forming couplers is a magenta dye-forming coupler.

3. A photographic element as claimed in claim 1, wherein said first image dye-forming coupler is a cyan, magenta or yellow dye-forming coupler.

4. A photographic element as claimed in claim 3, wherein said first image dye-forming coupler is a phenol coupler, a naphthol coupler, a pyrazolone coupler, a pyrazolotriazole coupler, a pivaloylacetanalide coupler or a benzoylacetanilide coupler.

5. A photographic element as claimed in claim 4, wherein said first image dye-forming coupler is a pyrazolotriazole coupler or a pyrazolone coupler.

6. A photographic element as claimed in claim 5, wherein said first image dye-forming coupler is a pyrazolotriazole having N in positions 1, 2, 4 and 5, a pyrazolotriazole having N in positions 1, 3, 4 and 5, a 1-(aryl)- or 1-(alkyl)-3-acylamino-5-pyrazolone or a 1-(aryl)- or 1-(alkyl)-3-anilino-5-pyrazolone.

7. A photographic element as claimed in claim 6, wherein said first image dye-forming coupler is selected from the group consisting of couplers A-1 to A-38 set forth in the specification.

8. A photographic element as claimed in claim 7, wherein said first coupler is selected from the group consisting of:

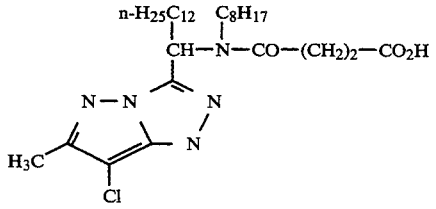

and

-continued

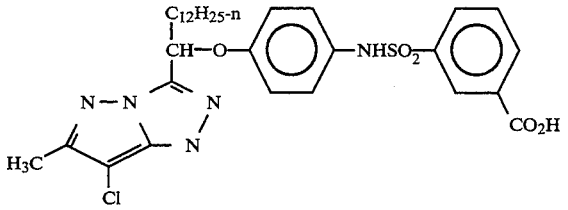

9. A photographic element as claimed in claim 3, wherein said first image dye-forming coupler is selected from the group consisting of couplers C-1 to C-12 set forth in the specification.

10. A photographic element as claimed in claim 9, wherein said first image dye-forming coupler is

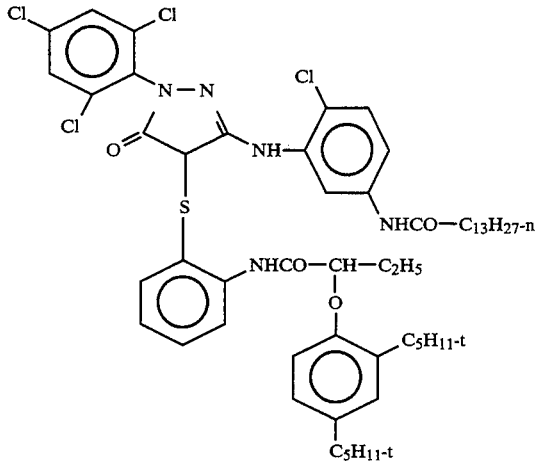

11. A photographic element as claimed in claim 2, wherein said second image dye-forming coupler is a magenta dye-forming coupler.

12. A photographic element as claimed in claim 11, wherein said second image dye-forming coupler is a pyrazolotriazole coupler or a pyrazolone coupler.

13. A photographic element as claimed in claim 12, wherein said second image dye-forming coupler is a pyrazolotriazole having N in positions 1, 2, 4 and 5, a pyrazolotriazole having N in positions 1, 3, 4 and 5, or a 1-(aryl)- or 1-(alkyl)-3-anilino-5-pyrazolone.

14. A photographic element as claimed in claim 13, wherein said second image dye-forming coupler is selected from the group consisting of

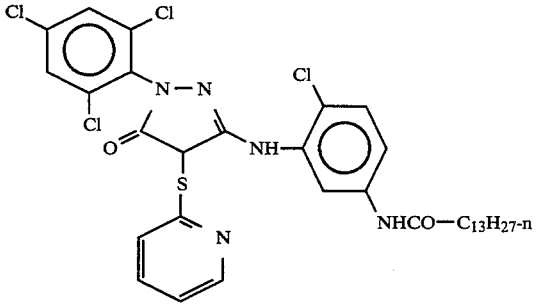

-continued
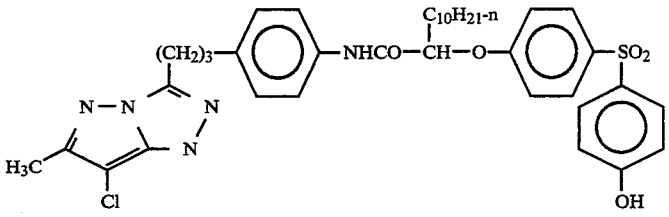
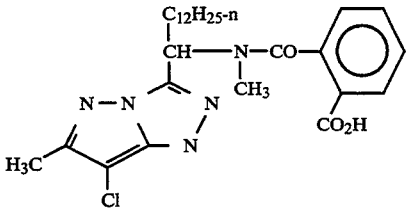
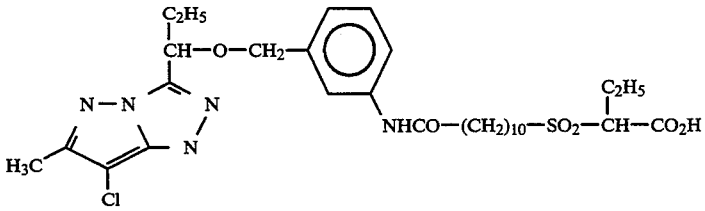
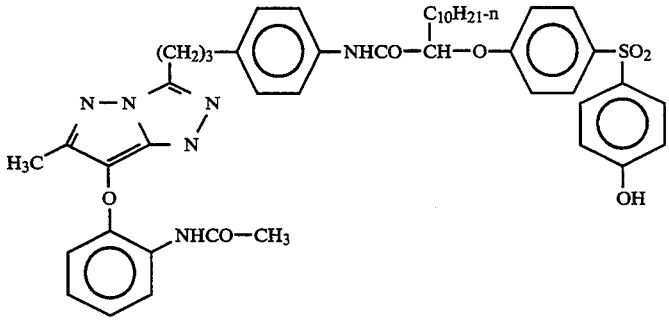
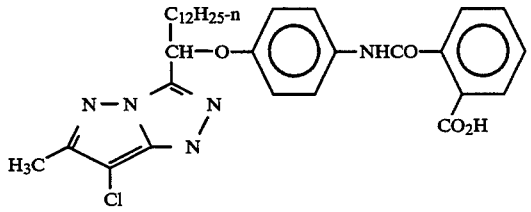
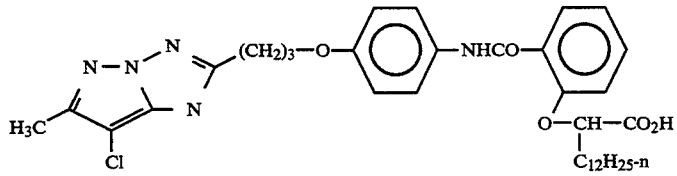
and -continued

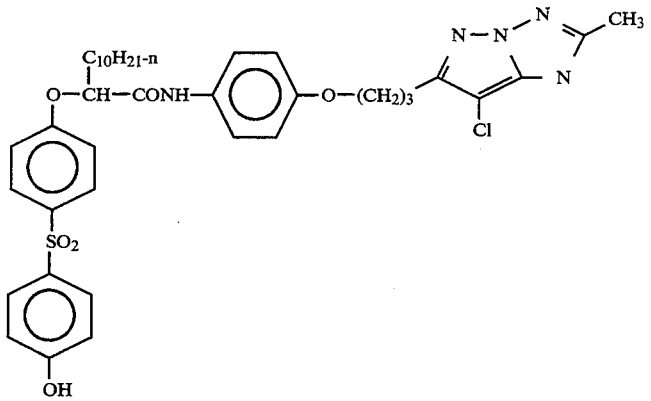

15. A photographic element as claimed in claim 14, wherein said second image dye-forming coupler is

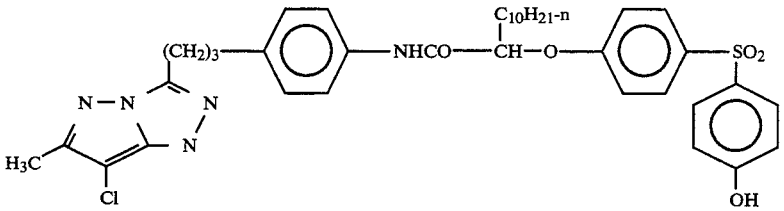

16. A photographic element as claimed in claim 1, wherein said first image dye-forming coupler is selected from the group consisting of

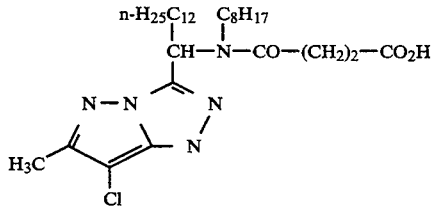

and

-continued

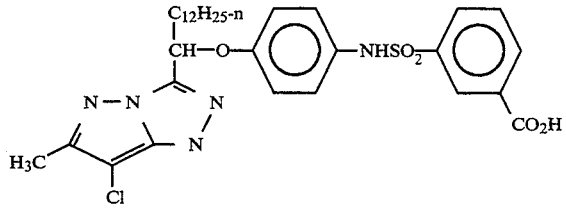

and said second image dye-forming coupler is

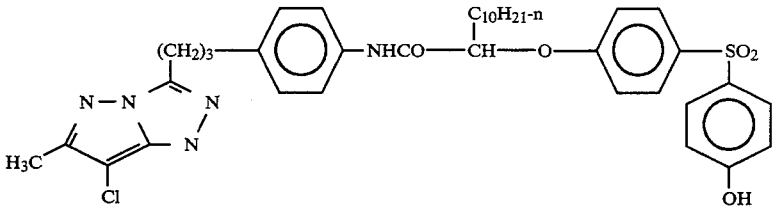

17. A photographic element as claimed in claim 16, wherein said first image dye-forming coupler is

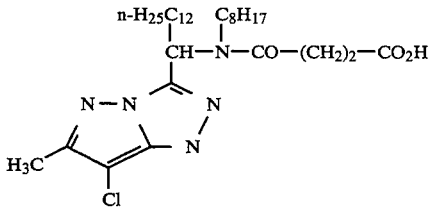

and said second image dye-forming coupler is

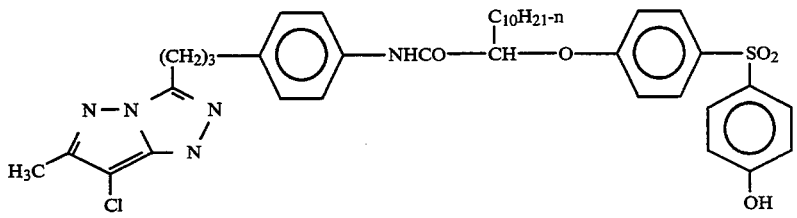

18. A photographic element as claimed in claim 1, wherein said first image dye-forming coupler is present in an amount from about 5 to 95 mol % relative to said second image dye-forming coupler.

19. A photographic element as claimed in claim 1, comprising a plurality of image dye-forming couplers which do not intrinsically inhibit development of said silver halide in combination with said image dye-forming coupler which intrinsically inhibits development of said silver halide.

20. A photographic element as claimed in claim 1, comprising an image dye-forming coupler which does

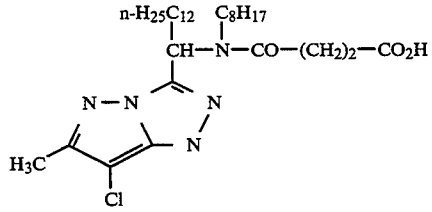

is not present in combination with intrinsically inhibiting coupler

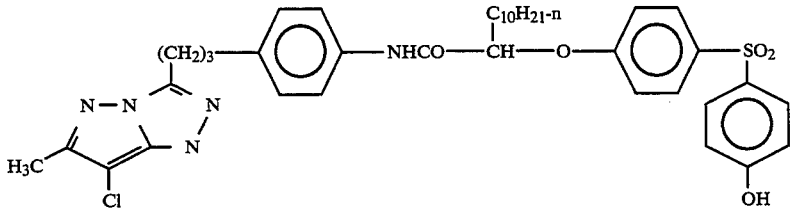

not intrinsically inhibit development of said silver halide in combination with a plurality of image dye-forming couplers which intrinsically inhibit development of said silver halide.

21. A photographic element as claimed in claim 20, comprising a plurality of image dye-forming couplers which do not intrinsically inhibit development of said silver halide.

22. A photographic element as claimed in claim 1, wherein said silver halide emulsion comprises silver bromide, silver iodide, silver bromoiodide or a mixture thereof.

23. A photographic element as claimed in claim 1, further comprising a DIR compound.

24. A photographic element as claimed in claim 1, comprising a tabular grain silver halide emulsion having an aspect ratio greater than about 3.

25. A photographic element as claimed in claim 1, comprising a tabular grain silver halide emulsion having a tabularity greater than about 25.

26. A photographic element comprising a support, a silver halide emulsion, a first image dye-forming coupler which does not intrinsically inhibit development of said silver halide, and a second image dye-forming coupler which intrinsically inhibits development of said silver halide, said first and second image dye-forming couplers being in reactive association with said silver halide emulsion, wherein intrinsically non-inhibiting coupler wherein said first image-dye forming coupler enables development of at least 80% of the silver developed in the presence of coupler A-9, and wherein said second image dye-forming coupler is not a development inhibitor releasing coupler and enables development of less than 80% of the silver developed in the presence of coupler A-9, with the proviso that said first image-dye forming coupler is selected from the group consisting of couplers A-1 to A-38 and C-1 to C-12 and/or with the proviso that said second image-dye forming coupler is selected from the group consisting of B-1 to B-8.

27. A multicolor photographic element comprising a support bearing a cyan dye image-forming unit comprising at least one red-sensitive silver halide emulsion layer having associated therewith at least one cyan dye-forming coupler, a magenta dye image-forming unit comprising at least one green-sensitive silver halide emulsion layer having associated therewith at least two magenta dye-forming couplers, and a yellow dye image-forming unit comprising at least one blue-sensitive silver halide emulsion layer having associated therewith at least one yellow dye-forming coupler, wherein said first magenta dye image-forming coupler does not intrinsically inhibit development of silver halide and said second magenta dye-forming coupler intrinsically inhibits development of silver halide, wherein said first magenta-dye forming coupler enables development of at least 80% of the silver developed in the presence of coupler A-9, and wherein said second magenta dye-forming coupler is not a development inhibitor releasing coupler and enables development of less than 80% of the silver developed in the presence of coupler A-9, with the proviso that said first image-dye forming coupler is selected from the group consisting of couplers A-1 to A-38 and C-1 to C-12 and/or with the proviso that said second image-dye forming coupler is selected from the group consisting of B-1 B-8.

28. A process for developing an image in a photographic element comprising a support and a silver halide emulsion containing an imagewise distribution of developable silver halide grains, said process comprising the step of developing said element with a silver halide color developing agent in the presence of a first image dye-forming coupler which does not intrinsically inhibit development of said silver halide and a second image dye-forming coupler which intrinsically inhibits development of said silver halide, wherein said first image-dye forming coupler enables development of at least 80% of the silver developed in the presence of coupler A-9, and wherein said second image dye-forming coupler is not a development inhibitor releasing coupler and enables development of less than 80% of the silver developed in the presence of coupler A-9, with the proviso that said first image-dye forming coupler is selected from the group consisting of couplers A-1 to A-38 and C-1 to C-12 and/or with the proviso that said second image-dye forming coupler is selected from the group consisting of B-1 to B-8.

29. A process as claimed in claim 28, wherein at least one of said first and second image dye-forming couplers is a magenta dye-forming coupler.

30. A process as claimed in claim 28, wherein said first coupler is selected from the group consisting of:

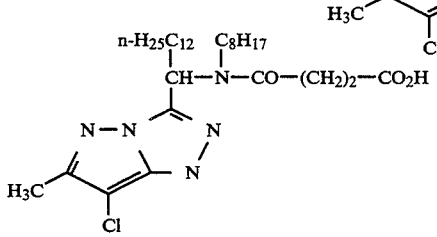

and

-continued

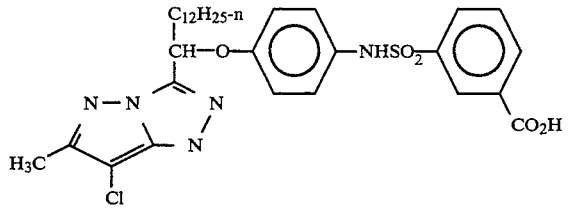

31. A process as claimed in claim 29, wherein said second image dye-forming coupler is a magenta dye-forming coupler.

32. A process as claimed in claim 31, wherein said second image dye-forming coupler is

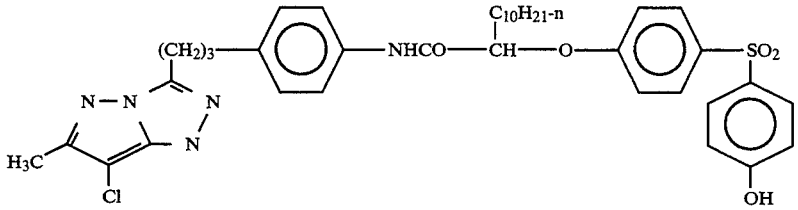

33. A process for developing an image in a photographic element comprising a support and a silver halide emulsion containing an imagewise distribution of developable silver halide grains, said process comprising the step of developing said element with a silver halide color developing agent in the presence of a first image dye-forming coupler which does not intrinsically inhibit development of said silver halide and a second image dye-forming coupler which intrinsically inhibits development of said silver halide, wherein intrinsically non-inhibiting coupler

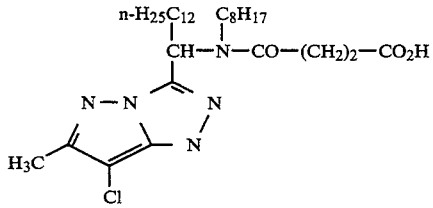

is not employed in combination with intrinsically inhibiting coupler

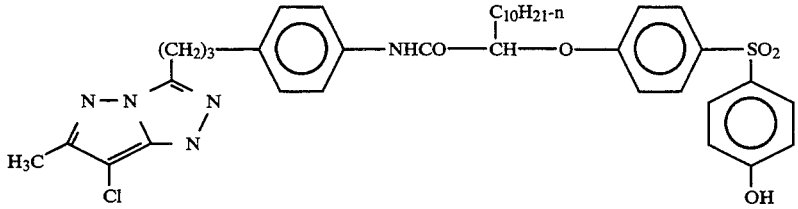

wherein said first image-dye forming coupler enables development of at least 80% of the silver developed in the presence of coupler A-9, and wherein said second image dye-forming coupler is not a development inhibitor releasing coupler and enables development of less than 80% of the silver developed in the presence of coupler A-9, with the proviso that said first image-dye forming coupler is selected from the group consisting of couplers A-1 to A-38 and C-1 to C-12 and/or with the proviso that said second image-dye forming coupler is selected from the group consisting of B-1 to B-8.

34. A photographic silver halide emulsion containing a first image dye-forming coupler which does not intrinsically inhibit development of said silver halide and a second image dye-forming coupler which intrinsically inhibits development of said silver halide, said first and second image dye-forming couplers being in reactive association with said silver halide emulsions, wherein said first image-dye forming coupler enables development of at least 80% of the silver developed in the presence of coupler A-9, and wherein said second image dye-forming coupler is

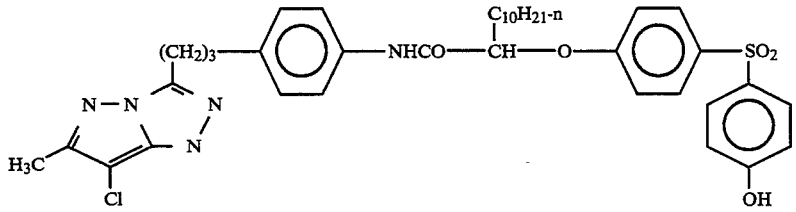

not a development inhibitor releasing coupler and enables development of less than 80% of the silver developed in the presence of coupler A-9, with the proviso that said first image-dye forming coupler is selected from the group consisting of couplers A-1 to A-38 and C-1 to C-12 and/or with the proviso that said second image-dye forming coupler is selected from the group consisting of B-1 to B-8.

35. A photographic silver halide emulsion as claimed in claim 34, wherein at least one of said first and second image dye-forming couplers is a magenta dye-forming coupler.

36. A photographic silver halide emulsion as claimed in claim 34, wherein said first coupler is selected from the group consisting of:

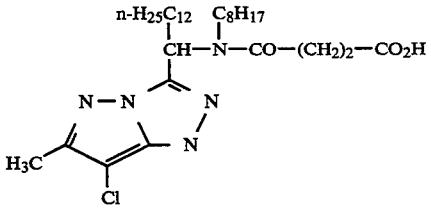

and

-continued

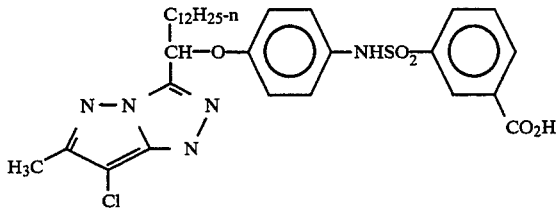

37. A photographic silver halide emulsion as claimed in claim 35, wherein said second image dye-forming coupler is a magenta dye-forming coupler.

38. A photographic silver halide emulsion as claimed in claim 37, wherein said second image dye-forming coupler is

39. A photographic silver halide emulsion comprising a first image dye-forming coupler which does not intrinsically inhibit development of said silver halide and a second image dye-forming coupler which intrinsically inhibits development of said silver halide, said first and second image dye-forming couplers being in reactive association with said silver halide emulsion, wherein intrinsically non-inhibiting coupler

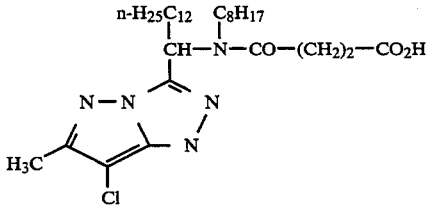

is not present in combination with intrinsically inhibiting coupler

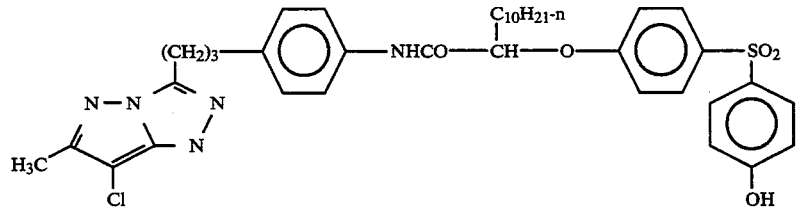

wherein said first image-dye forming coupler enables development of at least 80% of the silver developed in the presence of coupler A-9, and wherein said second image dye-forming coupler is not a development inhibitor releasing coupler and enables development of less than 80% of the silver developed in the presence of coupler A-9, with the proviso that said first image-dye forming coupler is selected from the group consisting of couplers A-1 to A-38 and C-1 to C-12 and/or with the proviso that said second image-dye forming coupler is selected from the group consisting of B-1 to B-8.

40. A photographic element as claimed in claim 1, wherein said second image dye-forming coupler comprises a -pyridyl, —COOH, or -sulfonylphenol moiety.

41. A photographic element as claimed in claim 1, wherein said first image dye-forming coupler is a pyrazolotriazole having N in positions 1, 2, 4 and 5, a pyrazolotriazole having N in positions 1, 3, 4 and 5, a 1-(aryl)- or 1-(alkyl)-3-acylamino-5-pyrazolone or a 1-(aryl)- or 1-(alkyl)-3-anilino-5-pyrazolone and wherein said second image dye-forming coupler is a pyrazolotriazole having N in positions 1, 2, 4 and 5, a pyrazolotriazole having N in positions 1, 3, 4 and 5, or a 1-(aryl)- or 1-(alkyl)-3-anilino-5-pyrazolone.

42. A photographic element comprising a support, a silver halide emulsion, a first image dye-forming coupler which does not intrinsically inhibit development of said silver halide, and a second image dye-forming coupler which intrinsically inhibits development of said silver halide, said first and second image dye-forming couplers being in reactive association with said silver halide emulsion, wherein said first image-dye forming coupler enables development of at least 80% of the silver developed in the presence of coupler A-9, and wherein said second image dye-forming coupler is not a development inhibitor releasing coupler and enables development of less than 80% of the silver developed in the presence of coupler A-9, wherein at least one of said first and second image dye-forming couplers is a magenta dye-forming coupler, and wherein said second image dye-forming coupler comprises a -pyridyl, —COOH, or sulfonyl phenol moiety.

43. A photographic element comprising a support, a silver halide emulsion, a first image dye-forming coupler which does not intrinsically inhibit development of said silver halide, and a second image dye-forming coupler which intrinsically inhibits development of said silver halide, said first and second image dye-forming couplers being in reactive association with said silver halide emulsion, wherein said first image-dye forming coupler enables development of at least 80% of the silver developed in the presence of coupler A-9, and wherein said second image dye-forming coupler is not a development inhibitor releasing coupler and enables development of less than 80% of the silver developed in the presence of coupler A-9, wherein said first image dye-forming coupler is a pyrazolotriazole having N in positions 1, 2, 4 and 5, a pyrazolotriazole having N in positions 1, 3, 4 and 5, a 1-(aryl)- or 1-(alkyl)-3-acylamino-5-pyrazolone or a 1-(aryl)- or 1-(alkyl)-3-anilino-5-pyrazolone.

44. A photographic element comprising a support, a silver halide emulsion, a first image dye-forming coupler which does not intrinsically inhibit development of said silver halide, and a second image dye-forming coupler which intrinsically inhibits development of said silver halide, said first and second image dye-forming couplers being in reactive association with said silver halide emulsion, wherein said first image-dye forming coupler enables development of at least 80% of the silver developed in the presence of coupler A-9, and wherein said second image dye-forming coupler is not a development inhibitor releasing coupler and enables development of less than 80% of the silver developed in the presence of coupler A-9, wherein said second image dye-forming coupler is a pyrazolotriazole having N in positions 1, 2, 4 and 5, a pyrazolotriazole having N in positions 1, 3, 4 and 5, or a 1-(aryl)- or 1-(alkyl)-3-anilino-5-pyrazolone.

45. A photographic element as claimed in claim 44, wherein said second image dye-forming coupler is a pyrazolotriazole having N in positions 1, 2, 4 and 5 or a pyrazolotriazole having N in positions 1, 3, 4 and 5.

46. A photographic element comprising a support, a silver halide emulsion, a first image dye-forming coupler which does not intrinsically inhibit development of said silver halide, and a second image dye-forming coupler which intrinsically inhibits development of said silver halide, said first and second image dye-forming couplers being in reactive association with said silver halide emulsion, wherein said first image-dye forming coupler is a pyrazolotriazole or pyrazolone magenta dye-forming coupler which enables development of at least 80% of the silver developed in the presence of coupler A-9, and wherein said second image dye-forming coupler is pyrazolotriazole or pyrazolone magenta dye-forming coupler which is not a development inhibitor releasing coupler and enables development of less than 80% of the silver developed in the presence of coupler A-9.

47. A photographic element as claimed in claim 46, wherein said second image dye-forming coupler is a pyrazolotriazole.

48. A photographic element as claimed in claim 47, wherein said first image dye-forming coupler is a pyrazolotriazole.

49. A photographic element comprising a support, a silver halide emulsion, a first image dye-forming coupler which does not intrinsically inhibit development of said silver halide, and a second image dye-forming coupler which intrinsically inhibits development of said silver halide, said first and second image dye-forming couplers being in reactive association with said silver halide emulsion, wherein said first image-dye forming coupler enables development of at least 80% of the silver developed in the presence of coupler A-9, and wherein said second image dye-forming coupler is not a development inhibitor releasing coupler and enables development of less than 80% of the silver developed in the presence of coupler A-9.

50. A photographic element comprising a support, a silver halide emulsion, a first image dye-forming coupler which does not intrinsically inhibit development of said silver halide, and a second image dye-forming coupler which intrinsically inhibits development of said silver halide, said first and second image dye-forming couplers being in reactive association with said silver halide emulsion, wherein said first image-dye forming coupler enables development of at least 80% of the silver developed in the presence of coupler A-9, and wherein said second image dye-forming coupler is not a development inhibitor releasing coupler and enables development of less than 80% of the silver developed in the presence of coupler A-9, wherein said first or second coupler is a bicyclic coupler comprising eight non-metallic ring atoms at least four of which are nitrogen atoms and at least one of which is a carbon atom which provides a coupling site.

* * * * *

UNITED STATES PATENT AND TRADEMARK OFFICE

CERTIFICATE OF CORRECTION

PATENT NO. : 5,399,472

DATED : March 21, 1995

INVENTOR(S) : Jeffrey L. Hall et al.

It is certified that error appears in the above-indentified patent and that said Letters Patent is hereby corrected as shown below:

Col 43, line 3, after "A-9" and before "," insert --of the specification-

Col 43, line 7, after "A-9" and before "," insert --of the specification-

Col 43, line 10, after "C-12" insert --of the specification--

Col 43, line 12, after "of" insert --couplers--

Col 43, line 13, after "B-8" and before "." insert --of the specification--

Col 50, line 38, after "A-9" and before "," insert --of the specification--

UNITED STATES PATENT AND TRADEMARK OFFICE

CERTIFICATE OF CORRECTION

PATENT NO. : 5,399,472

DATED : March 21, 1995

INVENTOR(S) : Jeffrey L. Hall et al.

It is certified that error appears in the above-indentified patent and that said Letters Patent is hereby corrected as shown below:

Col 50, line 42, after "A-9" and before "," insert --of the specification--

Col 50, line 45, after "C-12" insert --of the specification--

Col 50, line 47, after "of" insert --couplers--

Col 50, line 48, after "B8" and before "." insert --of the specification--

Col 50, line 66, after "A-9" and before "," insert --of the specification--

Col 51, line 2, after "A-9" and before "," insert --of the specification--

Col 51, line 5, after "C-12" insert --of the specification--

Col 51, line 7, after "of" insert --couplers--

Col 51, line 8, after "B-8" and before "." insert --of the specification--

Col 51, line 31, after "A-9" and before "," insert --of the specification--

UNITED STATES PATENT AND TRADEMARK OFFICE

CERTIFICATE OF CORRECTION

PATENT NO. : 5,399,472

DATED : March 21, 1995

INVENTOR(S) : Jeffrey L. Hall et al.

It is certified that error appears in the above-indentified patent and that said Letters Patent is hereby corrected as shown below:

Col 51, line 35, after "A-9" and before "," insert --of the specification--

Col 51, line 38, after "C-12" insert --of the specification--

Col 51, line 40, after "of" insert --couplers--

Col 51, line 41, after "B-8" and before "." insert --of the specification--

Col 52, line 64, after "A-9" and before "," insert --of the specification--

Col 52, line 68, after "A-9" and before "," insert --of the specification--

Col 53, line 3, after "C-12" insert --of the specification--

Col 53, line 5, after "of" insert --couplers--

Col 53, line 6, after "B-8" and before "," insert --of the specification--

Col 53, line 16, after "A-9" and before "," insert --of the specification--

UNITED STATES PATENT AND TRADEMARK OFFICE

CERTIFICATE OF CORRECTION

PATENT NO. : 5,399,472
DATED : March 21, 1995
INVENTOR(S) : Jeffrey L. Hall et al It is certified that error appears in the above-indentified patent and that said Letters Patent is hereby corrected as shown below:

Col 53, line 31, after "A-9" and before "," insert --of the specification--

Col 53, line 34, after "C-12" insert --of the specification--

Col 53, line 36, after "of" insert --couplers--

Col 53, line 37, after "B-8" and before "." insert --of the specification--

Col 54, line 61, after "A-9" and before "," insert --of the specification--

Col 54, line 65, after "A-9" and before "," insert --of the specification--

Col 54, line 68, after "C-12" insert --of the specification--

Col 55, line 2, after "of" insert --couplers--

Col 55, line 3, after "B-8" and before "." insert --of the specification--

Col 55, line 26, after "A-9" and before "," insert --of the specification--

UNITED STATES PATENT AND TRADEMARK OFFICE

CERTIFICATE OF CORRECTION

PATENT NO. : 5,399,472

DATED : March 21, 1995

INVENTOR(S) : Jeffrey L. Hall et al.

It is certified that error appears in the above-indentified patent and that said Letters Patent is hereby corrected as shown below:

Col 55, line 30, after "A-9" and before "," insert --of the specification--

Col 55, line 47, after "A-9" and before "," insert --of the specification--

Col 55, line 51, after "A-9" and before "," insert --of the specification--

Col 55, line 66, after "A-9" and before "," insert --of the specification--

Col 56, line 2, after "A-9" and before "," insert --of the specification--

Col 56, line 22, after "A-9" and before "," insert --of the specification--

UNITED STATES PATENT AND TRADEMARK OFFICE

CERTIFICATE OF CORRECTION

PATENT NO. : 5,399,472
DATED : March 21, 1995
INVENTOR(S) : Jeffrey L. Hall, et al It is certified that error appears in the above-indentified patent and that said Letters Patent is hereby corrected as shown below:

Col 56, line 28, after "A-9" and before "." insert --of the specification--

Col 56, line 44, after "A-9" and before "," insert --of the specification--

Col 56, line 48, after "A-9" and before "." insert --of the specification--

Col 56, line 58, after "A-9" and before "," insert --of the specification--

Col 56, line 62, after "A-9" and before "," insert --of the specification--

Signed and Sealed this

Eighteenth Day of July, 1995

*Attest:*

Bruce Lehman

BRUCE LEHMAN

*Attesting Officer*

*Commissioner of Patents and Trademarks*